US011613983B2

(12) United States Patent
Benson et al.

(10) Patent No.: US 11,613,983 B2
(45) Date of Patent: Mar. 28, 2023

(54) SYSTEM AND METHOD FOR ANALYSIS AND CONTROL OF DRILLING MUD AND ADDITIVES

(71) Applicant: Motive Drilling Technologies, Inc., Dallas, TX (US)

(72) Inventors: Todd W. Benson, Dallas, TX (US); George Michalopulos, Tulsa, OK (US); Richard Kulavik, Frisco, TX (US); Jarrod Shawn Deverse, Greenwood Village, CO (US)

(73) Assignee: Motive Drilling Technologies, Inc., Dallas, TX (US)

( * ) Notice: Subject to any disclaimer, the term of this patent is extended or adjusted under 35 U.S.C. 154(b) by 637 days.

(21) Appl. No.: 16/252,439

(22) Filed: Jan. 18, 2019

(65) Prior Publication Data

US 2019/0226336 A1 Jul. 25, 2019

Related U.S. Application Data

(60) Provisional application No. 62/748,996, filed on Oct. 22, 2018, provisional application No. 62/689,631,
(Continued)

(51) Int. Cl.
*E21B 44/00* (2006.01)
*E21B 44/02* (2006.01)
(Continued)

(52) U.S. Cl.
CPC ..... *E21B 44/00* (2013.01); *E21B 7/04* (2013.01); *E21B 21/01* (2013.01); *E21B 44/02* (2013.01);
(Continued)

(58) Field of Classification Search
CPC ..... E21B 49/10; E21B 47/008
See application file for complete search history.

(56) References Cited

U.S. PATENT DOCUMENTS 2,742,265 A 4/1956 Snyder
4,794,534 A 12/1988 Millheim
(Continued)

FOREIGN PATENT DOCUMENTS

GB 2236782 4/1991
WO 9817894 A2 4/1998
(Continued)

OTHER PUBLICATIONS

Saputelli, et al., "Real-Time Decision-Making for Value Creation While Drilling," SPE/IADC 85314; Middle East Drilling Technology Conference & Exhibition held in Abu Dhabi, UAE, Oct. 20-22, 2003, 19 Pages.
(Continued)

*Primary Examiner* — Robert E Fuller
*Assistant Examiner* — Neel Girish Patel
(74) *Attorney, Agent, or Firm* — Kilpatrick Townsend & Stockton LLP

(57) ABSTRACT

Analysis and control of drilling mud and additives is disclosed using a mud analysis system and a mud additive system that may automatically monitor and control the drilling mud during drilling of a well. The mud analysis system may acquire measurements on a sample of the drilling mud during drilling, and may send signals indicative of the drilling mud to a steering control system enabled to control the drilling. The steering control system may receive user input or may make decisions regarding additives to be added to the drilling mud and the timing thereof. The mud
(Continued)

additive system may be enabled to receive commands from the steering control system and mix and add additives to the drilling mud.

38 Claims, 12 Drawing Sheets

Related U.S. Application Data filed on Jun. 25, 2018, provisional application No. 62/619,247, filed on Jan. 19, 2018.

(51) Int. Cl.

| | |
|---|---|
| ***E21B 49/00*** | (2006.01) |
| ***E21B 7/04*** | (2006.01) |
| ***E21B 47/12*** | (2012.01) |
| ***E21B 21/01*** | (2006.01) |
| *E21B 47/10* | (2012.01) |

(52) U.S. Cl.

CPC ..... *E21B 47/12* (2013.01); *E21B 49/00* (2013.01); *E21B 49/005* (2013.01); *E21B 47/10* (2013.01)

(56) References Cited

U.S. PATENT DOCUMENTS

| | | | | |
|---|---|---|---|---|
| 5,193,628 | A | 3/1993 | Hill et al. | |
| 5,220,963 | A | 6/1993 | Patton | |
| 5,390,748 | A | 2/1995 | Goldman | |
| 5,465,799 | A | 11/1995 | Ho | |
| 5,812,068 | A | 9/1998 | Wisler et al. | |
| 5,857,531 | A | 1/1999 | Estep et al. | |
| 6,088,294 | A | 7/2000 | Balogh | |
| 6,233,524 | B1 | 5/2001 | Harrell et al. | |
| 6,257,356 | B1 | 7/2001 | Wassell | |
| 6,272,434 | B1 | 8/2001 | Wisler | |
| 6,279,702 | B1 | 8/2001 | Koh | |
| 6,405,808 | B1 | 6/2002 | Edwards et al. | |
| 6,408,953 | B1 | 6/2002 | Goldman et al. | |
| 6,424,919 | B1 | 7/2002 | Moran et al. | |
| 6,470,977 | B1 | 10/2002 | Chen et al. | |
| 6,523,623 | B1 | 2/2003 | Schuh | |
| 6,577,954 | B2 | 6/2003 | Alft et al. | |
| 6,581,699 | B1 | 6/2003 | Chen et al. | |
| 6,601,658 | B1 | 8/2003 | Downton | |
| 6,612,382 | B2 | 9/2003 | King | |
| 6,732,052 | B2 | 5/2004 | MacDonald et al. | |
| 6,736,221 | B2 | 5/2004 | Chia et al. | |
| 6,944,547 | B2 * | 9/2005 | Womer | E21B 44/00 702/7 |
| 7,000,710 | B1 | 2/2006 | Umbach | |
| 7,003,439 | B2 | 2/2006 | Aldred et al. | |
| 7,011,156 | B2 | 3/2006 | Von Gynz-Rekowski | |
| 7,032,689 | B2 | 4/2006 | Goldman et al. | |
| 7,054,750 | B2 | 5/2006 | Rodney et al. | |
| 7,085,696 | B2 | 8/2006 | King | |
| 7,136,795 | B2 | 11/2006 | Downton | |
| 7,142,986 | B2 | 11/2006 | Moran | |
| 7,243,719 | B2 | 7/2007 | Baron et al. | |
| 7,264,050 | B2 | 9/2007 | Koithan et al. | |
| 7,342,504 | B2 | 3/2008 | Crane et al. | |
| 7,460,957 | B2 | 12/2008 | Prange et al. | |
| 7,606,666 | B2 | 10/2009 | Repin et al. | |
| 7,653,563 | B2 | 1/2010 | Veeningen et al. | |
| 7,684,929 | B2 | 3/2010 | Prange et al. | |
| 7,725,263 | B2 | 5/2010 | Sugiura | |
| 7,823,655 | B2 | 11/2010 | Boone et al. | |
| 7,860,593 | B2 | 12/2010 | Boone | |
| 7,938,197 | B2 | 5/2011 | Boone et al. | |
| 7,945,488 | B2 | 5/2011 | Karr et al. | |
| 7,957,946 | B2 | 6/2011 | Pirovolou | |
| 8,010,290 | B2 | 8/2011 | Illfelder | |
| 8,210,283 | B1 * | 7/2012 | Benson | E21B 45/00 175/61 |
| 8,463,550 | B1 | 6/2013 | Selman | |
| 8,763,842 | B2 | 7/2014 | Johnson et al. | |
| 9,494,030 | B2 | 11/2016 | Benson et al. | |
| 9,908,148 | B2 | 3/2018 | Torrione | |
| 2001/0042642 | A1 | 11/2001 | King | |
| 2001/0054514 | A1 | 12/2001 | Sullivan et al. | |
| 2002/0070050 | A1 | 6/2002 | Wassell | |
| 2002/0103630 | A1 | 8/2002 | Alfred | |
| 2002/0139581 | A1 | 10/2002 | Schultz et al. | |
| 2003/0024738 | A1 | 2/2003 | Schuh | |
| 2004/0047234 | A1 | 3/2004 | Armstrong et al. | |
| 2004/0168811 | A1 | 9/2004 | Aeschbacher | |
| 2005/0006145 | A1 | 1/2005 | Downton | |
| 2005/0150689 | A1 | 7/2005 | Jogi et al. | |
| 2005/0194130 | A1 | 9/2005 | Best | |
| 2005/0194185 | A1 | 9/2005 | Gleitman | |
| 2005/0269082 | A1 | 12/2005 | Baron et al. | |
| 2006/0074561 | A1 | 4/2006 | Xia | |
| 2006/0151214 | A1 | 7/2006 | Prange | |
| 2007/0163810 | A1 | 7/2007 | Umderwood et al. | |
| 2007/0221375 | A1 | 9/2007 | Baron et al. | |
| 2008/0172272 | A1 | 7/2008 | Back et al. | |
| 2008/0230272 | A1 | 9/2008 | Chen et al. | |
| 2008/0271925 | A1 | 11/2008 | Misselbrook et al. | |
| 2009/0000823 | A1 | 1/2009 | Pirovolou | |
| 2009/0076873 | A1 | 3/2009 | Johnson et al. | |
| 2009/0090555 | A1 | 4/2009 | Boone et al. | |
| 2009/0120690 | A1 | 5/2009 | Phillips | |
| 2010/0139977 | A1 | 6/2010 | Watkins et al. | |
| 2010/0175922 | A1 | 7/2010 | Ignova et al. | |
| 2010/0191516 | A1 | 7/2010 | Benish | |
| 2010/0243657 | A1 * | 9/2010 | Johnson | C09K 8/03 220/500 |
| 2010/0252327 | A1 | 10/2010 | Beuershausen et al. | |
| 2010/0259415 | A1 | 10/2010 | Strachan | |
| 2011/0067928 | A1 | 3/2011 | Huldren | |
| 2011/0153300 | A1 | 6/2011 | Holl | |
| 2011/0186353 | A1 | 8/2011 | Turner | |
| 2011/0213601 | A1 | 9/2011 | Pirovolou | |
| 2012/0027516 | A1 | 2/2012 | Day et al. | |
| 2012/0048621 | A1 | 3/2012 | Stewart et al. | |
| 2012/0285701 | A1 | 11/2012 | Cheng | |
| 2013/0032401 | A1 | 2/2013 | Edbury et al. | |
| 2013/0032402 | A1 | 2/2013 | Byreddy et al. | |
| 2013/0092441 | A1 | 4/2013 | Hummes | |
| 2013/0112484 | A1 | 5/2013 | Chen | |
| 2013/0126239 | A1 | 5/2013 | Panchal et al. | |
| 2013/0140037 | A1 | 6/2013 | Sequeira | |
| 2013/0161096 | A1 | 6/2013 | Benson et al. | |
| 2013/0262048 | A1 | 10/2013 | Tang et al. | |
| 2013/0340999 | A1 | 12/2013 | Benson | |
| 2016/0130889 | A1 | 5/2016 | Torrione | |
| 2016/0130917 | A1 | 5/2016 | Torrione | |
| 2016/0134843 | A1 | 5/2016 | Torrione | |
| 2016/0305230 | A1 | 10/2016 | Benson et al. | |
| 2017/0234125 | A1 * | 8/2017 | Zhang | E21B 47/18 175/40 |
| 2017/0274333 | A1 * | 9/2017 | Smith | B01F 15/00389 |
| 2017/0343969 | A1 * | 11/2017 | Dykstra | E21B 44/005 |

FOREIGN PATENT DOCUMENTS

| | | |
|---|---|---|
| WO | 2009039448 | 3/2009 |
| WO | 2013191839 A1 | 12/2013 |
| WO | 2016108908 A1 | 7/2016 |

OTHER PUBLICATIONS

Patent Cooperation Treaty: International Preliminary Report on Patentability for PCT/US2013/047054; dated Dec. 23, 2014, Brassart, P., 9 Pages.

Pastusek et al, "A Fundamental Model for Prediction of Hole Curvature and Build Rates With Steerable Bottomhole Assemblies," Society of Petroleum Engineers, 2005 SPE Annual Technical Conference and Exhibit, copyright 2005.

(56) References Cited

OTHER PUBLICATIONS

Schlumberger Oifield Glossary entry for "ROP" or "rate of penetration," accessed via www.glossary.oilfield.slb.com on Aug. 4, 2014.
Dictionary definition of "system," accessed via thefreedictionary.com on Aug. 4, 2014.
EP19740873.5, "Extended European Search Report", dated Sep. 17, 2021, 7 pages.
PCT/US2019/014343, "International Preliminary Report on Patentability", dated Apr. 24, 2019, 11 pages.
PCT/US2019/014343, "International Search Report and Written Opinion", dated Apr. 24, 2019, 12 pages.
EP19740873.5, "Office Action", dated Nov. 16, 2022, 5 pages.

* cited by examiner

SYSTEM AND METHOD FOR ANALYSIS AND CONTROL OF DRILLING MUD AND ADDITIVES

CROSS-REFERENCE TO RELATED APPLICATIONS

This application claims priority to and the benefit of U.S. Provisional Patent Application No. 62/619,247, filed on Jan. 19, 2018 entitled "System and Method for Managing Drilling Mud and Additives", and also claims priority to and the benefit of U.S. Provisional Patent Application No. 62/689,631, filed on Jun. 25, 2018 entitled "System and Method for Well Drilling Control Based on Borehole Cleaning", and also claims priority to and the benefit of U.S. Provisional Patent Application No. 62/748,996, filed on Oct. 22, 2018 entitled "Systems and Methods for Oilfield Drilling Operations Using Computer Vision", all of which are hereby incorporated by reference herein.

BACKGROUND

Field of the Disclosure

The present disclosure relates generally to drilling of wells for oil and gas production and, more particularly, to a system and method for analysis and control of drilling mud and additives.

Description of the Related Art

Drilling a borehole for the extraction of minerals has become an increasingly complicated operation due to the increased depth and complexity of many boreholes, including the complexity added by directional drilling. Drilling is an expensive operation and errors in drilling add to the cost and, in some cases, drilling errors may permanently lower the output of a well for years into the future. Conventional technologies and methods may not adequately address the complicated nature of drilling, and may not be capable of gathering and processing various information from downhole sensors and surface control systems in a timely manner, in order to improve drilling parameters and minimize drilling errors.

In particular, conventional manual techniques for analyzing and controlling drilling mud using drilling, including adding additives to the drilling mud during drilling, may not be efficient or timely and may result in undesirable errors.

SUMMARY

In one aspect, a drilling mud system is disclosed. The drilling mud system includes a mud analysis system enabled for diverting a sample of drilling mud obtained from a well during drilling of the well to analyze the sample using a plurality of sensors. The drilling mud system further includes a mud additive system enabled for adding a predetermined amount of drilling mud or an additive to the drilling mud circulated into the well and a mud control system. In the drilling mud system, the mud control system may be enabled for receiving an indication of the drilling mud from the sensors of the mud analysis system, transmitting the indication of the drilling mud to a steering control system enabled for controlling a plurality of drilling parameters for the well. receiving a command from the steering control system indicating a first time and a first additive for adding to the drilling mud, and causing the mud additive system to add the first additive at the first time to the drilling mud.

In any of the disclosed embodiments of the drilling mud system, the mud analysis system may be enabled to analyze a plurality of samples, including the sample, at a predetermined time interval during drilling of the well.

In any of the disclosed embodiments of the drilling mud system, the indication may be indicative of a first property of the sample. In the drilling mud system, the first property may be determined by at least one of the sensors.

In any of the disclosed embodiments of the drilling mud system, the sensors may further include at least one of the group consisting of: a mud resistivity sensor, a mud rheology sensor, a mud temperature sensor, a mud density sensor, a mud gamma ray sensor, a mud pH sensor, a mud chemical sensor, a mud magnetic sensor, a mud weight sensor, a mud particle sensor, and a mud image analysis system.

In any of the disclosed embodiments of the drilling mud system, the first property may be selected from at least one of the group consisting of: a mud resistivity, a mud viscosity, a mud temperature, a mud density, a mud gamma ray level, a mud pH value, a mud chemical composition, a mud particle chemical composition, a mud particle size distribution, a mud particle shape, a mud magnetic susceptibility, and a mud weight.

In any of the disclosed embodiments of the drilling mud system, at least one of the sensors may be enabled to qualitatively identify in the sample at least one of the group consisting of: hydrocarbons, oil, grease, rubber, and ferrous metals.

In any of the disclosed embodiments of the drilling mud system, at least one of the sensors may be enabled to quantitatively identify in the sample at least one of the group consisting of: hydrocarbons, oil, grease, rubber, or ferrous metals.

In any of the disclosed embodiments of the drilling mud system, the steering control system may be enabled for adjusting at least one of the drilling parameters based on the indication, which may further include generating a comparison of a first value associated with the first property with a first threshold value for the first property, and adjusting at least one of the drilling parameters based on the comparison.

In any of the disclosed embodiments of the drilling mud system, adjusting the drilling parameters may further include adjusting at least one of the group of drilling parameters consisting of: a rate of penetration (ROP), a weight on bit (WOB), a drilling rotational velocity (RPM), a mud circulation rate, a mud pressure, and a direction of the well.

In any of the disclosed embodiments of the drilling mud system, the mud control system may be enabled for causing the steering control system to display a visual indication of the first property.

In any of the disclosed embodiments of the drilling mud system, the indication may be associated with an identification of a geological formation.

In any of the disclosed embodiments of the drilling mud system, the steering control system may be enabled for comparing the identification of the geological formation to a drill plan for the well.

In any of the disclosed embodiments of the drilling mud system, the first additive may include a loss circulation material (LCM).

In any of the disclosed embodiments of the drilling mud system, the first additive may include a pre-packaged additive.

In any of the disclosed embodiments of the drilling mud system, the central steering unit may be enabled for receiving user input specifying the first additive and the first time, and generating the command based in the user input.

In any of the disclosed embodiments of the drilling mud system, the mud additive system may further include a mud additive mixer enabled to quantitatively mix a plurality of additives included in the first additive for adding to the drilling mud according to user input received by the steering control system.

In any of the disclosed embodiments of the drilling mud system, the mud analysis system may be enabled for generating a plurality of indications respectively associated with a plurality of properties of the sample, including the first property, and interpreting, by the steering control system, the plurality of signals to identify the plurality of properties.

In another aspect, a first method of drilling mud analysis and control is disclosed. The first method may include diverting a sample of drilling mud obtained from a well during drilling of the well to a mud analysis system enabled to analyze the sample using a plurality of sensors, generating, by the mud analysis system, a first signal indicative of at least a first property of the sample. In the first method, the first property may be determined by at least one of the sensor. The first method may further include transmitting the first signal to a steering control system enabled to control at least one drilling parameter used for drilling the well, interpreting the first signal by the steering control system to identify at least the first property of the sample. In the first method, the steering control system may be enabled to correlate the sample with a depth of the well. The first method may also include, based on at least the first property, adjusting, by the steering control system, the at least one drilling parameter for the well.

In any of the disclosed embodiments of the first method, adjusting the drilling parameters for the well may further include adjusting a position of a drill bit in the well.

In any of the disclosed embodiments of the first method, the steering control system being enabled to correlate the sample with a depth of the well may further include at least one selected from the group consisting of: comparing the first property with a drill plan for the well, identifying a time of drilling from a first timestamp indicative of the first signal and a travel time of the drilling mud to the surface, and identifying a pressure of the drilling mud indicative of a velocity of the drilling mud.

In any of the disclosed embodiments of the first method, comparing the first property with the drill plan may further include comparing the first property with drill plan information associated with the depth in the drill plan.

In any of the disclosed embodiments of the first method, the first property may be determined using at least one of the group of sensors consisting of: a mud resistivity sensor, a mud rheology sensor, a mud temperature sensor, a mud density sensor, a mud gamma ray sensor, a mud pH sensor, a mud chemical sensor, a mud magnetic sensor, a mud weight sensor, a mud particle sensor, and a mud image analysis system.

In any of the disclosed embodiments of the first method, the first property may be selected from at least one of the group consisting of: a mud resistivity, a mud viscosity, a mud temperature, a mud density, a mud gamma ray level, a mud pH value, a mud chemical composition, a mud particle chemical composition, a mud particle size distribution, a mud particle shape, a mud magnetic susceptibility, and a mud weight.

In any of the disclosed embodiments of the first method, at least one of the sensors may be enabled to qualitatively identify hydrocarbons, oil, grease, metal, and rubber in the sample.

In any of the disclosed embodiments of the first method, at least one of the sensors may be enabled to quantitatively identify hydrocarbons, oil, grease, metal, and rubber in the sample.

In any of the disclosed embodiments, the first method may further include generating, by the mud analysis system, a plurality of signals including the first signal, the plurality of signals respectively associated with a plurality of properties of the sample, including the first property, and interpreting, by the steering control system, the plurality of signals to identify the plurality of properties of the sample.

In any of the disclosed embodiments of the first method, adjusting the drilling parameters based on the first property may further include generating a comparison of a first value associated with the first property with a first threshold value for the first property, and adjusting, by the steering control system, at least one of the drilling parameters based on the comparison.

In any of the disclosed embodiments, the first method may further include logging, by the steering control system, the first property versus the depth.

In any of the disclosed embodiments of the first method, logging the first property versus the depth may further include generating a log display of at least the first property versus the depth.

In yet another aspect, a second method of drilling mud analysis and control is disclosed. The second method may include receiving, at a mud additive system coupled to a drilling rig, a first additive request from a steering control system of the drilling rig. In the second method, the first additive request may specify a composition of a first additive to be added to drilling mud used for drilling by the drilling rig. The second method may further include, based on the first additive request, mixing the composition of the first additive from at least one additive supplied to the mud additive system. In the second method, the mud additive system may include a mud additive mixer enabled to mix the composition of the first additive. The second method may also include dosing the first additive into the drilling mud.

In any of the disclosed embodiments of the second method, the first additive may include a second additive that is a loss circulation material (LCM).

In any of the disclosed embodiments of the second method, the first additive may include a third additive that is a lubricant.

In any of the disclosed embodiments of the second method, the first additive may be supplied in a packaged form. In any of the disclosed embodiments of the second method, the packaged form may be a cable. In any of the disclosed embodiments of the second method, the packaged form may be a plurality of unit-sized containers.

In any of the disclosed embodiments of the second method, the first additive may be selected from at least one of the group consisting of: a liquid, a colloid, a solid-liquid mixture, a solute dissolved in a solvent, a powder, and a particulate.

In any of the disclosed embodiments of the second method, receiving the first additive request from the steering control system may further include receiving user input by the steering control system to generate the first additive request. In the second method, the user input may specify at least one of the group consisting of: the composition of the first additive, a particle size, a density, a concentration of the first additive in the drilling mud, and a time of delivery of the first additive.

In any of the disclosed embodiments of the second method, dosing the first additive into the drilling mud may further include dosing the first additive at a given rate into the drilling mud to achieve a specified concentration of the first additive in the drilling mud.

In any of the disclosed embodiments, the second method may further include receiving, at the mud additive system, a second additive request from the steering control system. In the second method, the second additive request may specify a composition of a second additive and a drilling operation planned for execution by the steering control system after a minimum delay period.

In any of the disclosed embodiments of the second method, the composition of the second additive may include a lubricant, while the drilling operation may include a slide.

In any of the disclosed embodiments of the second method, the minimum delay period may depend on at least one of the group consisting of: a rate of penetration (ROP), a weight on bit (WOB), a differential pressure, a rotational velocity of a drill bit, a measured depth, a mud flow rate, a drill plan, and a threshold delay value.

BRIEF DESCRIPTION OF THE DRAWINGS

For a more complete understanding of the present invention and its features and advantages, reference is now made to the following description, taken in conjunction with the accompanying drawings, in which.

DESCRIPTION OF PARTICULAR EMBODIMENT(S)

Figure 1:
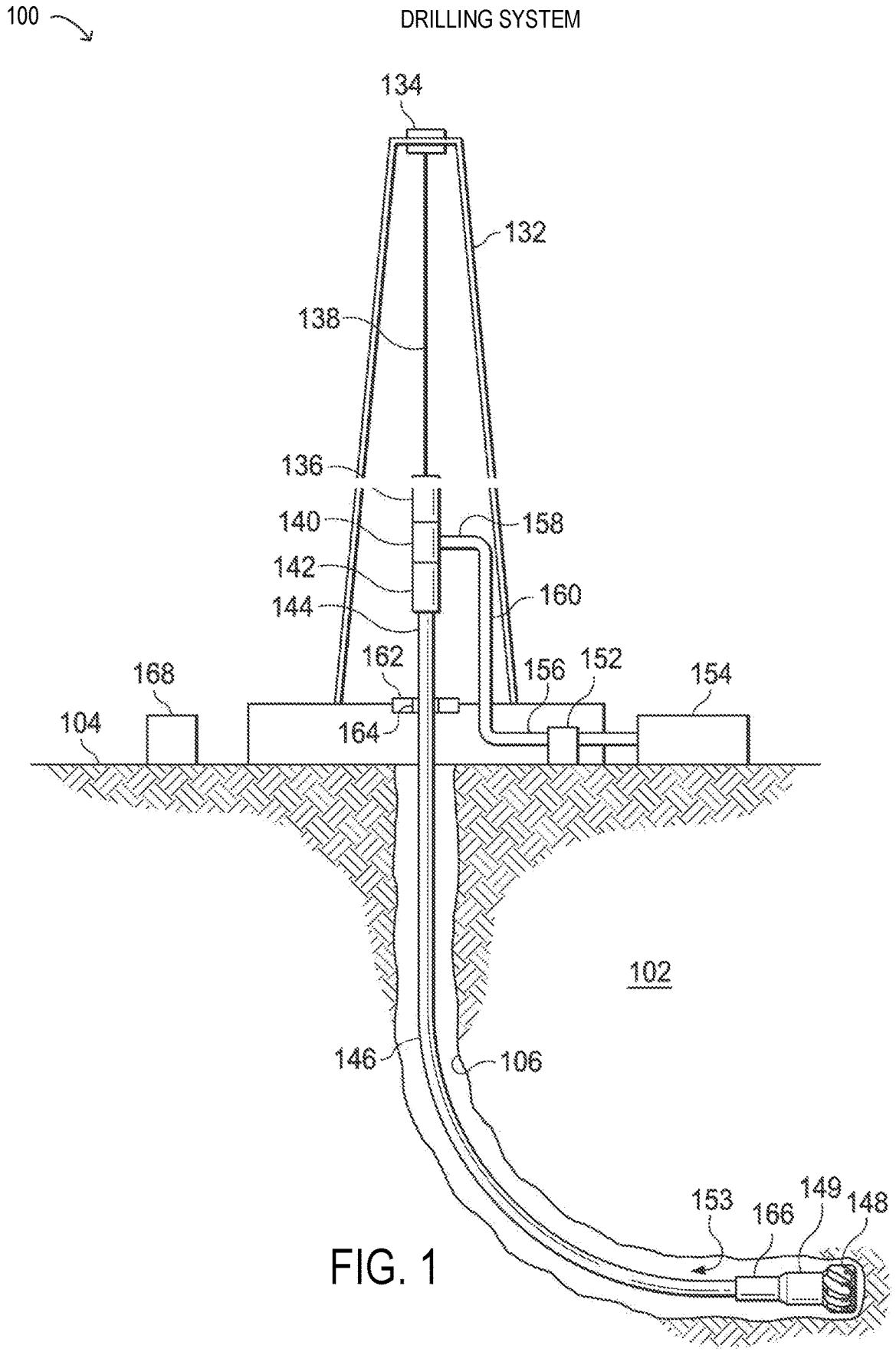
FIG. 1 is a depiction of a drilling system for drilling a borehole.

In the following description, details are set forth by way of example to facilitate discussion of the disclosed subject matter. It should be apparent to a person of ordinary skill in the field, however, that the disclosed embodiments are exemplary and not exhaustive of all possible embodiments.

Throughout this disclosure, a hyphenated form of a reference numeral refers to a specific instance of an element and the un-hyphenated form of the reference numeral refers to the element generically or collectively. Thus, as an example (not shown in the drawings), device "12-1" refers to an instance of a device class, which may be referred to collectively as devices "12" and any one of which may be referred to generically as a device "12". In the figures and the description, like numerals are intended to represent like elements.

Drilling a well typically involves a substantial amount of human decision-making during the drilling process. For example, geologists and drilling engineers use their knowledge, experience, and the available information to make decisions on how to plan the drilling operation, how to accomplish the drill plan, and how to handle issues that arise during drilling. However, even the best geologists and drilling engineers perform some guesswork due to the unique nature of each borehole. Furthermore, a directional human driller performing the drilling may have drilled other boreholes in the same region and so may have some similar experience. However, during drilling operations, a multitude of input information and other factors may affect a drilling decision being made by a human operator or specialist, such that the amount of information may overwhelm the cognitive ability of the human to properly consider and factor into the drilling decision. Furthermore, the quality or the error involved with the drilling decision may improve with larger amounts of input data being considered, for example, such as formation data from a large number of offset wells. For these reasons, human specialists may be unable to achieve optimal drilling decisions, particularly when such drilling decisions are made under time constraints, such as during drilling operations when continuation of drilling is dependent on the drilling decision and, thus, the entire drilling rig waits idly for the next drilling decision. Furthermore, human decision-making for drilling decisions can result in expensive mistakes, because drilling errors can add significant cost to drilling operations. In some cases, drilling errors may permanently lower the output of a well, resulting in substantial long term economic losses due to the lost output of the well.

Referring now to the drawings, Referring to FIG. 1, a drilling system 100 is illustrated in one embodiment as a top drive system. As shown, the drilling system 100 includes a derrick 132 on the surface 104 of the earth and is used to drill a borehole 106 into the earth. Typically, drilling system 100 is used at a location corresponding to a geographic formation 102 in the earth that is known.

In FIG. 1, derrick 132 includes a crown block 134 to which a traveling block 136 is coupled via a drilling line 138. In drilling system 100, a top drive 140 is coupled to traveling block 136 and may provide rotational force for drilling. A saver sub 142 may sit between the top drive 140 and a drill pipe 144 that is part of a drill string 146. Top drive 140 may rotate drill string 146 via the saver sub 142, which in turn may rotate a drill bit 148 of a bottom hole assembly (BHA) 149 in borehole 106 passing through formation 102. Also visible in drilling system 100 is a rotary table 162 that may be fitted with a master bushing 164 to hold drill string 146 when not rotating.

A mud pump 152 may direct a fluid mixture (e.g., drilling mud 153) from a mud pit 154 into drill string 146. Mud pit 154 is shown schematically as a container, but it is noted that various receptacles, tanks, pits, or other containers may be used. Drilling mud 153 may flow from mud pump 152 into a discharge line 156 that is coupled to a rotary hose 158 by a standpipe 160. Rotary hose 158 may then be coupled to top drive 140, which includes a passage for drilling mud 153 to flow into borehole 106 via drill string 146 from where drilling mud 153 may emerge at drill bit 148. Drilling mud 153 may lubricate drill bit 148 during drilling and, due to the pressure supplied by mud pump 152, drilling mud 153 may return via borehole 106 to surface 104.

In drilling system 100, drilling equipment (see also FIG. 5) is used to perform the drilling of borehole 106, such as top drive 140 (or rotary drive equipment) that couples to drill string 146 and BHA 149 and is configured to rotate drill string 146 and apply pressure to drill bit 148. Drilling system 100 may include control systems such as a WOB/differential pressure control system 522, a positional/rotary control system 524, a fluid circulation control system 526, and a sensor system 528, as further described below with respect to FIG. 5. The control systems may be used to monitor and change drilling rig settings, such as the WOB or differential pressure to alter the ROP or the radial orientation of the toolface, change the flow rate of drilling mud, and perform other operations. Sensor system 528 may be for obtaining sensor data about the drilling operation and drilling system 100, including the downhole equipment. For example, sensor system 528 may include MWD or logging while drilling (LWD) tools for acquiring information, such as toolface and formation logging information, that may be saved for later retrieval, transmitted with or without a delay using any of various communication means (e.g., wireless, wireline, or mud pulse telemetry), or otherwise transferred to steering control system 168. As used herein, an MWD tool is enabled to communicate downhole measurements without substantial delay to the surface 104, such as using mud pulse telemetry, while a LWD tool is equipped with an internal memory that stores measurements when downhole and can be used to download a stored log of measurements when the LWD tool is at the surface 104. The internal memory in the LWD tool may be a removable memory, such as a universal serial bus (USB) memory device or another removable memory device. It is noted that certain downhole tools may have both MWD and LWD capabilities. Such information acquired by sensor system 528 may include information related to hole depth, bit depth, inclination angle, azimuth angle, true vertical depth, gamma count, standpipe pressure, mud flow rate, rotary rotations per minute (RPM), bit speed, ROP, WOB, among other information. It is noted that all or part of sensor system 528 may be incorporated into a control system, or in another component of the drilling equipment. As drilling system 100 can be configured in many different implementations, it is noted that different control systems and subsystems may be used.

Sensing, detection, measurement, evaluation, storage, alarm, and other functionality may be incorporated into a downhole tool 166 or BHA 149 or elsewhere along drill string 146 to provide downhole surveys of borehole 106. Accordingly, downhole tool 166 may be an MWD tool or a LWD tool or both, and may utilize connectivity to the surface 104, local storage, or both. In different implementations, gamma radiation sensors, magnetometers, accelerometers, and other types of sensors may be used for the downhole surveys. Although downhole tool 166 is shown in singular in drilling system 100, it is noted that multiple instances (not shown) of downhole tool 166 may be located at one or more locations along drill string 146.

In some embodiments, formation detection and evaluation functionality may be provided via a steering control system 168 on the surface 104. Steering control system 168 may be located in proximity to derrick 132 or may be included with drilling system 100. In other embodiments, steering control system 168 may be remote from the actual location of borehole 106 (see also FIG. 4). For example, steering control system 168 may be a stand-alone system or may be incorporated into other systems included with drilling system 100.

In operation, steering control system 168 may be accessible via a communication network (see also FIG. 10), and may accordingly receive formation information via the communication network. In some embodiments, steering control system 168 may use the evaluation functionality to provide corrective measures, such as a convergence plan to overcome an error in the well trajectory of borehole 106 with respect to a reference, or a planned well trajectory. The convergence plans or other corrective measures may depend on a determination of the well trajectory, and therefore, may be improved in accuracy using surface steering, as disclosed herein.

In particular embodiments, at least a portion of steering control system 168 may be located in downhole tool 166 (not shown). In some embodiments, steering control system 168 may communicate with a separate controller (not shown) located in downhole tool 166. In particular, steering control system 168 may receive and process measurements received from downhole surveys, and may perform the calculations described herein for surface steering using the downhole surveys and other information referenced herein.

In drilling system 100, to aid in the drilling process, data is collected from borehole 106, such as from sensors in BHA 149, downhole tool 166, or both. At least some of the collected data may also be obtained from surface sensors. The collected data may include characteristics of geological formation 102, the attributes of drilling system 100, including BHA 149, and drilling information such as weight-on-bit (WOB), drilling speed, rate of penetration (ROP), differential pressure (DP), among other information pertinent to the formation of borehole 106. The drilling information may be associated with a particular measured depth (MD) or another identifiable marker to index collected data. For example, the collected data for borehole 106 may capture drilling information indicating that drilling of the well from 1,000 feet to 1,200 feet occurred at a first ROP through a first geological formation with a first WOB, while drilling from 1,200 feet to 1,500 feet occurred at a second ROP through a second geological formation with a second WOB (see also FIG. 2). In some applications, the collected data may be used to virtually recreate the drilling process that created borehole 106 in formation 102, such as by displaying a computer simulation of the drilling process. The accuracy with which the drilling process can be recreated depends on a level of detail and accuracy of the collected data, including collected data from a downhole survey of the well trajectory.

The collected data may be stored in a database that is accessible via a communication network for example. In some embodiments, the database storing the collected data for borehole 106 may be located locally at drilling system 100, at a drilling hub that supports a plurality of drilling systems 100 in a region, or at a database server accessible over the communication network that provides access to the database (see also FIG. 4). At drilling system 100, the collected data may be stored at the surface 104 or downhole in drill string 146, such as in a memory device included with BHA 149 (see also FIG. 10). Alternatively, at least a portion of the collected data may be stored on a removable storage medium, such as using steering control system 168 or BHA 149, that is later coupled to the database in order to transfer the collected data to the database, which may be manually performed at certain intervals, for example.

In FIG. 1, steering control system 168 is located at or near the surface 104 where borehole 106 is being drilled. Steering control system 168 may be coupled to equipment used in drilling system 100 and may also be coupled to the database, whether the database is physically located locally, regionally, or centrally (see also FIGS. 4 and 5). Accordingly, steering control system 168 may collect and record various inputs, such as measurement data from a magnetometer and an accelerometer that may also be included with BHA 149. In some embodiments, at least certain portions of steering control system 168 may be located remotely from a drilling site.

Steering control system 168 may further be used as a surface steerable system, along with the database, as described above. The surface steerable system may enable an operator to plan and control drilling operations while drilling is being performed. The surface steerable system may itself also be used for certain drilling operations, such as controlling drilling parameters, controlling certain control systems that, in turn, control the actual equipment in drilling system 100 (see also FIG. 5), and monitoring various activity and the value of various drilling parameters. The control of drilling equipment and drilling parameters by steering control system 168 may be manual, manual-assisted, semi-automatic, or automatic, in different embodiments.

Manual control may involve direct control of the drilling rig equipment, albeit with certain safety limits to prevent unsafe or undesired actions or collisions of different equipment. To enable manual-assisted control, steering control system 168 may present various information, such as using a graphical user interface (GUI) displayed on a display device (see FIG. 8), to a human operator, and may provide controls that enable the human operator to perform a control operation. The information presented to the user may include live measurements and feedback from the drilling rig and steering control system 168, or the drilling rig itself, and may further include limits and safety-related elements to prevent unwanted actions or equipment states, in response to a manual control command entered by the user using the GUI.

To implement semi-automatic control, steering control system 168 may itself propose or indicate to the user, such as via the GUI, that a certain control operation, or a sequence of control operations, should be performed at a given time. Then, steering control system 168 may enable the user to initiate the indicated control operation or sequence of control operations, such that once manually started, the indicated control operation or sequence of control operations is automatically completed. The limits and safety features mentioned above for manual control could still apply for semi-automatic control. It is noted that steering control system 168 may execute semi-automatic control using a secondary processor, such as an embedded controller that executes under a real-time operating system (RTOS), that is under the control and command of steering control system 168. To implement automatic control, the step of manually starting the indicated control operation or sequence of operations can be replaced with automatic starting, and steering control system 168 may proceed with a passive notification to the user of the actions automatically taken.

In order to implement various control operations, steering control system 168 may perform (or may cause to be performed) various input operations, processing operations, and output operations. The input operations performed by steering control system 168 may result in measurements or other input information being made available for use in any subsequent operations, such as processing or output operations. The input operations may accordingly provide the input information, including feedback from the drilling process itself, to steering control system 168. The processing operations performed by steering control system 168 may be any processing operation associated with surface steering, as disclosed herein. The output operations performed by steering control system 168 may involve generating output information for use by external entities, or for output to a user, such as in the form of updated elements in the GUI, for example. The output information may include at least some of the input information, enabling steering control system 168 to distribute information among various entities and processors.

In particular, the operations performed by steering control system 168 may include operations such as receiving a drill plan, receiving drilling data representing a drill path, receiving other drilling parameters, calculating a drilling solution for the drill path based on the received data and other available data (e.g., rig characteristics), implementing the drilling solution at the drilling rig, monitoring the drilling process to gauge whether the drilling process is within a defined margin of error of the drill path, calculating corrections for the drilling process if the drilling process is outside of the margin of error, and implementing any calculated corrections by modifying drilling parameters, and updating the drill plan.

Accordingly, steering control system 168 may receive input information either before drilling, during drilling, or after drilling of borehole 106. The input information may comprise measurements from one or more sensors (either downhole sensors or surface sensors), as well as survey information collected while drilling borehole 106. The input information may also include the drill plan, a regional geological formation history, drilling engineer parameters, downhole toolface/inclination information, downhole tool GR/resistivity information, economic parameters (e.g., costs, risk estimates, profits, return on investment (ROI), etc.), reliability parameters, among various other parameters. Some of the input information, such as the regional formation history, may be available from a drilling hub 410, which may have respective access to a regional drilling database (DB) 412 (see FIG. 4). Other input information may be accessed or uploaded from other sources to steering control system 168. For example, a web interface may be used to interact directly with steering control system 168 to upload the drill plan or drilling parameters.

As noted, the input information may be provided to steering control system 168. After processing by steering control system 168, steering control system 168 may generate control information that may be output to drilling rig 210 (e.g., to rig controls 520 that control drilling equipment 530, see also FIGS. 2 and 5). Drilling rig 210 may provide feedback information using rig controls 520 to steering control system 168. The feedback information may then serve as input information to steering control system 168, thereby enabling steering control system 168 to perform feedback loop control and validation. Accordingly, steering control system 168 may be configured to modify its output information to the drilling rig, in order to achieve the desired results, which are indicated in the feedback information. The output information generated by steering control system 168 may include indications to modify one or more drilling parameters, the direction of drilling, the drilling mode, among others. In certain operational modes, such as semi-automatic or automatic, steering control system 168 may generate output information indicative of instructions to rig controls 520 to enable automatic drilling using the latest location of BHA 149. Therefore, an improved accuracy in the determination of the location of BHA 149 may be provided using steering control system 168, along with the methods and operations for surface steering disclosed herein.

Figure 2:
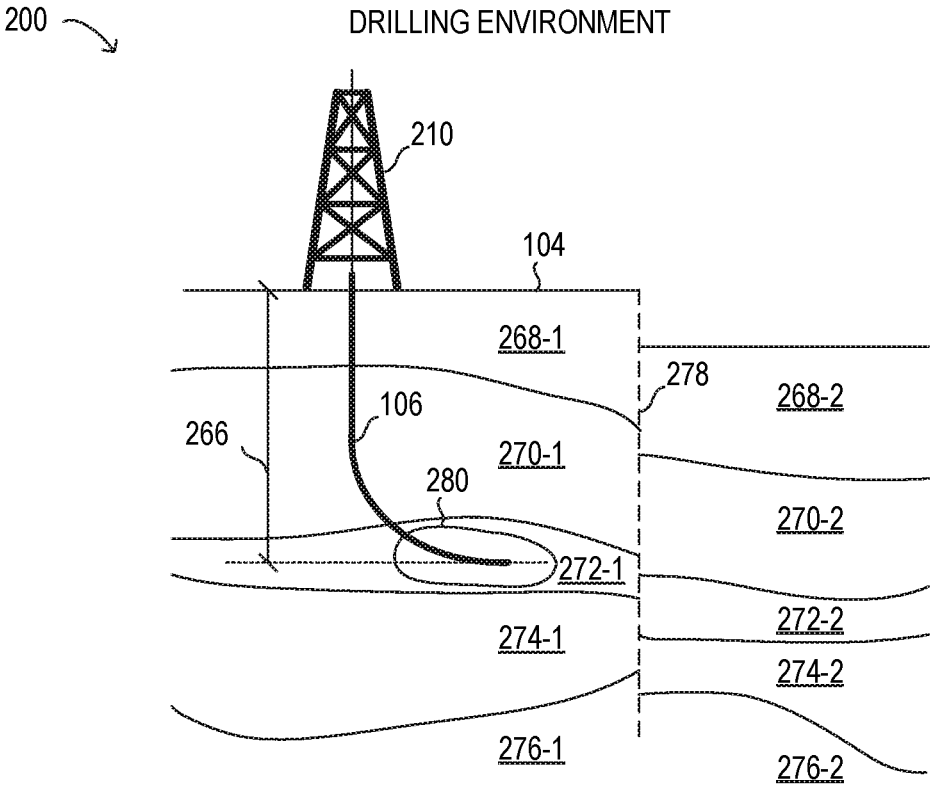
FIG. 2 is a depiction of a drilling environment including the drilling system for drilling a borehole.

Referring now to FIG. 2, a drilling environment 200 is depicted schematically and is not drawn to scale or perspective. In particular, drilling environment 200 may illustrate additional details with respect to formation 102 below the surface 104 in drilling system 100 shown in FIG. 1. In FIG. 2, drilling rig 210 may represent various equipment discussed above with respect to drilling system 100 in FIG. 1 that is located at the surface 104.

In drilling environment 200, it may be assumed that a drill plan (also referred to as a well plan) has been formulated to drill borehole 106 extending into the ground to a true vertical depth (TVD) 266 and penetrating several subterranean strata layers. Borehole 106 is shown in FIG. 2 extending through strata layers 268-1 and 270-1, while terminating in strata layer 272-1. Accordingly, as shown, borehole 106 does not extend or reach underlying strata layers 274-1 and 276-1. A target area 280 specified in the drill plan may be located in strata layer 272-1 as shown in FIG. 2. Target area 280 may represent a desired endpoint of borehole 106, such as a hydrocarbon producing area indicated by strata layer 272-1. It is noted that target area 280 may be of any shape and size, and may be defined using various different methods and information in different embodiments. In some instances, target area 280 may be specified in the drill plan using subsurface coordinates, or references to certain markers, that indicate where borehole 106 is to be located. In other instances, target area may be specified in the drill plan using a depth range within which borehole 106 is to remain. For example, the depth range may correspond to strata layer 272-1. In other examples, target area 280 may extend as far as can be realistically drilled. For example, when borehole 106 is specified to have a horizontal section with a goal to extend into strata layer 172 as far as possible, target area 280 may be defined as strata layer 272-1 itself and drilling may continue until some other physical limit is reached, such as a property boundary or a physical limitation to the length of the drill string.

Also visible in FIG. 2 is a fault line 278 that has resulted in a subterranean discontinuity in the geological formations. Specifically, strata layers 268, 270, 272, 274, and 276 have portions on either side of fault line 278. On one side of fault line 278, where borehole 106 is located, strata layers 268-1, 270-1, 272-1, 274-1, and 276-1 are unshifted by fault line 278. On the other side of fault line 278, strata layers 268-2, 270-3, 272-3, 274-3, and 276-3 are shifted downwards by fault line 278.

Current drilling operations frequently include directional drilling to reach a target, such as target area 280. The use of directional drilling has been found to generally increase an overall amount of production volume per well, but also may lead to significantly higher production rates per well, which are both economically desirable. As shown in FIG. 2, directional drilling may be used to drill the horizontal portion of borehole 106, which increases an exposed length of borehole 106 within strata layer 272-1, and which may accordingly be beneficial for hydrocarbon extraction from strata layer 272-1. Directional drilling may also be used alter an angle of borehole 106 to accommodate subterranean faults, such as indicated by fault line 278 in FIG. 2. Other benefits that may be achieved using directional drilling include sidetracking off of an existing well to reach a different target area or a missed target area, drilling around abandoned drilling equipment, drilling into otherwise inaccessible or difficult to reach locations (e.g., under populated areas or bodies of water), providing a relief well for an existing well, and increasing the capacity of a well by branching off and having multiple boreholes extending in different directions or at different vertical positions for the same well. Directional drilling is often not limited to a straight horizontal borehole 106, but may involve staying within a strata layer that varies in depth and thickness as illustrated by strata layer 172. As such, directional drilling may involve multiple vertical adjustments that complicate the trajectory of borehole 106.

Figure 3:
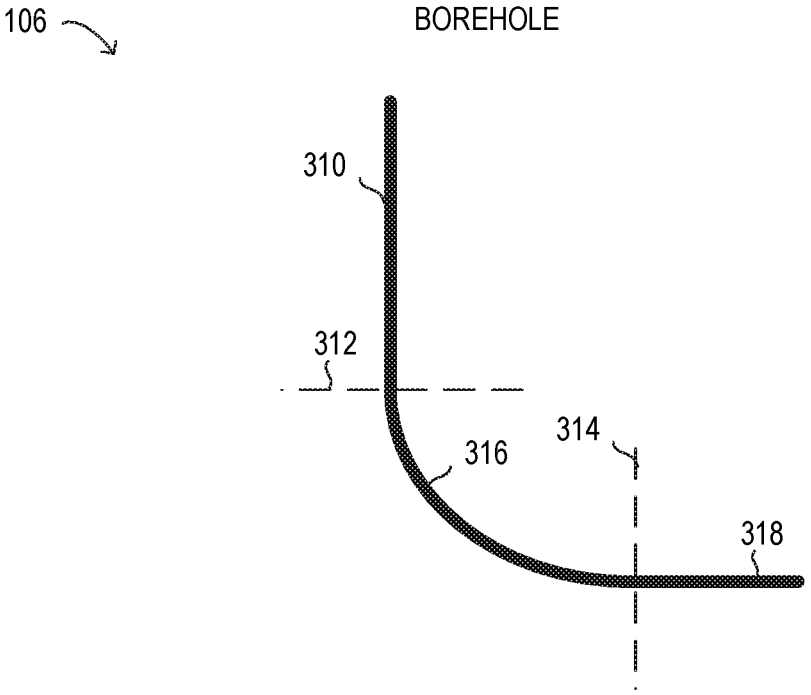
FIG. 3 is a depiction of a borehole generated in the drilling environment.

Referring now to FIG. 3, one embodiment of a portion of borehole 106 is shown in further detail. Using directional drilling for horizontal drilling may introduce certain challenges or difficulties that may not be observed during vertical drilling of borehole 106. For example, a horizontal portion 318 of borehole 106 may be started from a vertical portion 310. In order to make the transition from vertical to horizontal, a curve may be defined that specifies a so-called "build up" section 316. Build up section 316 may begin at a kick off point 312 in vertical portion 310 and may end at a begin point 314 of horizontal portion 318. The change in inclination in build up section 316 per measured length drilled is referred to herein as a "build rate" and may be defined in degrees per one hundred feet drilled. For example, the build rate may have a value of 6°/100 ft., indicating that there is a six degree change in inclination for every one hundred feet drilled. The build rate for a particular build up section may remain relatively constant or may vary.

The build rate used for any given build up section may depend on various factors, such as properties of the formation (i.e., strata layers) through which borehole 106 is to be drilled, the trajectory of borehole 106, the particular pipe and drill collars/BHA components used (e.g., length, diameter, flexibility, strength, mud motor bend setting, and drill bit), the mud type and flow rate, the specified horizontal displacement, stabilization, and inclination, among other factors. An overly aggressive built rate can cause problems such as severe doglegs (e.g., sharp changes in direction in the borehole) that may make it difficult or impossible to run casing or perform other operations in borehole 106. Depending on the severity of any mistakes made during directional drilling, borehole 106 may be enlarged or drill bit 146 may be backed out of a portion of borehole 106 and redrilled along a different path. Such mistakes may be undesirable due to the additional time and expense involved. However, if the built rate is too cautious, additional overall time may be added to the drilling process, because directional drilling generally involves a lower ROP than straight drilling. Furthermore, directional drilling for a curve is more complicated than vertical drilling and the possibility of drilling errors increases with directional drilling (e.g., overshoot and undershoot that may occur while trying to keep drill bit 148 on the planned trajectory).

Two modes of drilling, referred to herein as "rotating" and "sliding", are commonly used to form borehole 106. Rotating, also called "rotary drilling", uses top drive 140 or rotary table 162 to rotate drill string 146. Rotating may be used when drilling occurs along a straight trajectory, such as for vertical portion 310 of borehole 106. Sliding, also called "steering" or "directional drilling" as noted above, typically uses a mud motor located downhole at BHA 149. The mud motor may have an adjustable bent housing and is not powered by rotation of the drill string. Instead, the mud motor uses hydraulic power derived from the pressurized drilling mud that circulates along borehole 106 to and from the surface 104 to directionally drill borehole 106 in build up section 316.

Thus, sliding is used in order to control the direction of the well trajectory during directional drilling. A method to perform a slide may include the following operations. First, during vertical or straight drilling, the rotation of drill string 146 is stopped. Based on feedback from measuring equipment, such as from downhole tool 166, adjustments may be made to drill string 146, such as using top drive 140 to apply various combinations of torque, WOB, and vibration, among other adjustments. The adjustments may continue until a toolface is confirmed that indicates a direction of the bend of the mud motor is oriented to a direction of a desired deviation (e.g., a build rate) of borehole 106. Once the desired orientation of the mud motor is attained, WOB to the drill bit is increased, which causes the drill bit to move in the desired direction of deviation. Once sufficient distance and angle have been built up in the curved trajectory and the slide has been completed, a transition back to rotating mode can be accomplished by rotating the drill string again. The rotation of the drill string after sliding may neutralize the directional deviation caused by the bend in the mud motor due to the continuous rotation around a centerline of borehole 106.

Figure 4:
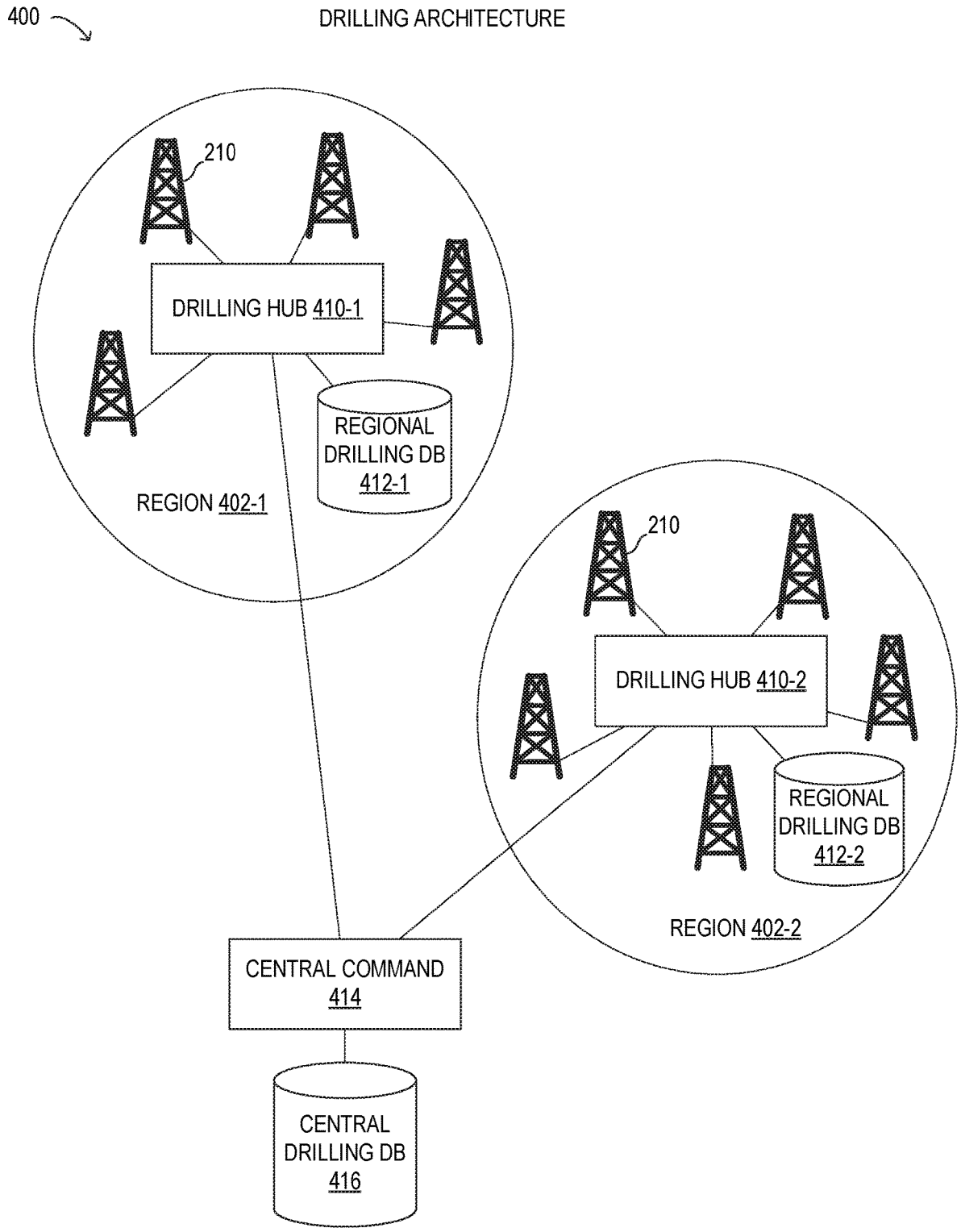
FIG. 4 is a depiction of a drilling architecture including the drilling environment.

Referring now to FIG. 4, a drilling architecture 400 is illustrated in diagram form. As shown, drilling architecture 400 depicts a hierarchical arrangement of drilling hubs 410 and a central command 414, to support the operation of a plurality of drilling rigs 210 in different regions 402. Specifically, as described above with respect to FIGS. 1 and 2, drilling rig 210 includes steering control system 168 that is enabled to perform various drilling control operations locally to drilling rig 210. When steering control system 168 is enabled with network connectivity, certain control operations or processing may be requested or queried by steering control system 168 from a remote processing resource. As shown in FIG. 4, drilling hubs 410 represent a remote processing resource for steering control system 168 located at respective regions 402, while central command 414 may represent a remote processing resource for both drilling hub 410 and steering control system 168.

Specifically, in a region 401-1, a drilling hub 410-1 may serve as a remote processing resource for drilling rigs 210 located in region 401-1, which may vary in number and are not limited to the exemplary schematic illustration of FIG. 4. Additionally, drilling hub 410-1 may have access to a regional drilling DB 412-1, which may be local to drilling hub 410-1. Additionally, in a region 401-2, a drilling hub 410-2 may serve as a remote processing resource for drilling rigs 210 located in region 401-2, which may vary in number and are not limited to the exemplary schematic illustration of FIG. 4. Additionally, drilling hub 410-2 may have access to a regional drilling DB 412-2, which may be local to drilling hub 410-2.

In FIG. 4, respective regions 402 may exhibit the same or similar geological formations. Thus, reference wells, or offset wells, may exist in a vicinity of a given drilling rig 210 in region 402, or where a new well is planned in region 402. Furthermore, multiple drilling rigs 210 may be actively drilling concurrently in region 402, and may be in different stages of drilling through the depths of formation strata layers at region 402. Thus, for any given well being drilled by drilling rig 210 in a region 402, survey data from the reference wells or offset wells may be used to create the drill plan, and may be used for surface steering, as disclosed herein. In some implementations, survey data or reference data from a plurality of reference wells may be used to improve drilling performance, such as by reducing an error in estimating TVD or a position of BHA 149 relative to one or more strata layers, as will be described in further detail herein. Additionally, survey data from recently drilled wells, or wells still currently being drilled, including the same well, may be used for reducing an error in estimating TVD or a position of BHA 149 relative to one or more strata layers.

Also shown in FIG. 4 is central command 414, which has access to central drilling DB 416, and may be located at a centralized command center that is in communication with drilling hubs 410 and drilling rigs 210 in various regions 402. The centralized command center may have the ability to monitor drilling and equipment activity at any one or more drilling rigs 210. In some embodiments, central command 414 and drilling hubs 412 may be operated by a commercial operator of drilling rigs 210 as a service to customers who have hired the commercial operator to drill wells and provide other drilling-related services.

In FIG. 4, it is particularly noted that central drilling DB 416 may be a central repository that is accessible to drilling hubs 410 and drilling rigs 210. Accordingly, central drilling DB 416 may store information for various drilling rigs 210 in different regions 402. In some embodiments, central drilling DB 416 may serve as a backup for at least one regional drilling DB 412, or may otherwise redundantly store information that is also stored on at least one regional drilling DB 412. In turn, regional drilling DB 412 may serve as a backup or redundant storage for at least one drilling rig 210 in region 402. For example, regional drilling DB 412 may store information collected by steering control system 168 from drilling rig 210.

In some embodiments, the formulation of a drill plan for drilling rig 210 may include processing and analyzing the collected data in regional drilling DB 412 to create a more effective drill plan. Furthermore, once the drilling has begun, the collected data may be used in conjunction with current data from drilling rig 210 to improve drilling decisions. As noted, the functionality of steering control system 168 may be provided at drilling rig 210, or may be provided, at least in part, at a remote processing resource, such as drilling hub 410 or central command 414.

As noted, steering control system 168 may provide functionality as a surface steerable system for controlling drilling rig 210. Steering control system 168 may have access to regional drilling DB 412 and central drilling DB 416 to provide the surface steerable system functionality. As will be described in greater detail below, steering control system 168 may be used to plan and control drilling parameters based on input information, including feedback from the drilling process itself. Steering control system 168 may be used to perform operations such as receiving drilling data representing a drill trajectory and other drilling parameters, calculating a drilling solution for the drill trajectory based on the received data and other available data (e.g., rig characteristics), implementing the drilling solution at drilling rig 210, monitoring the drilling process to gauge whether the drilling process is within a margin of error that is defined for the drill trajectory, or calculating corrections for the drilling process if the drilling process is outside of the margin of error.

Figure 5:
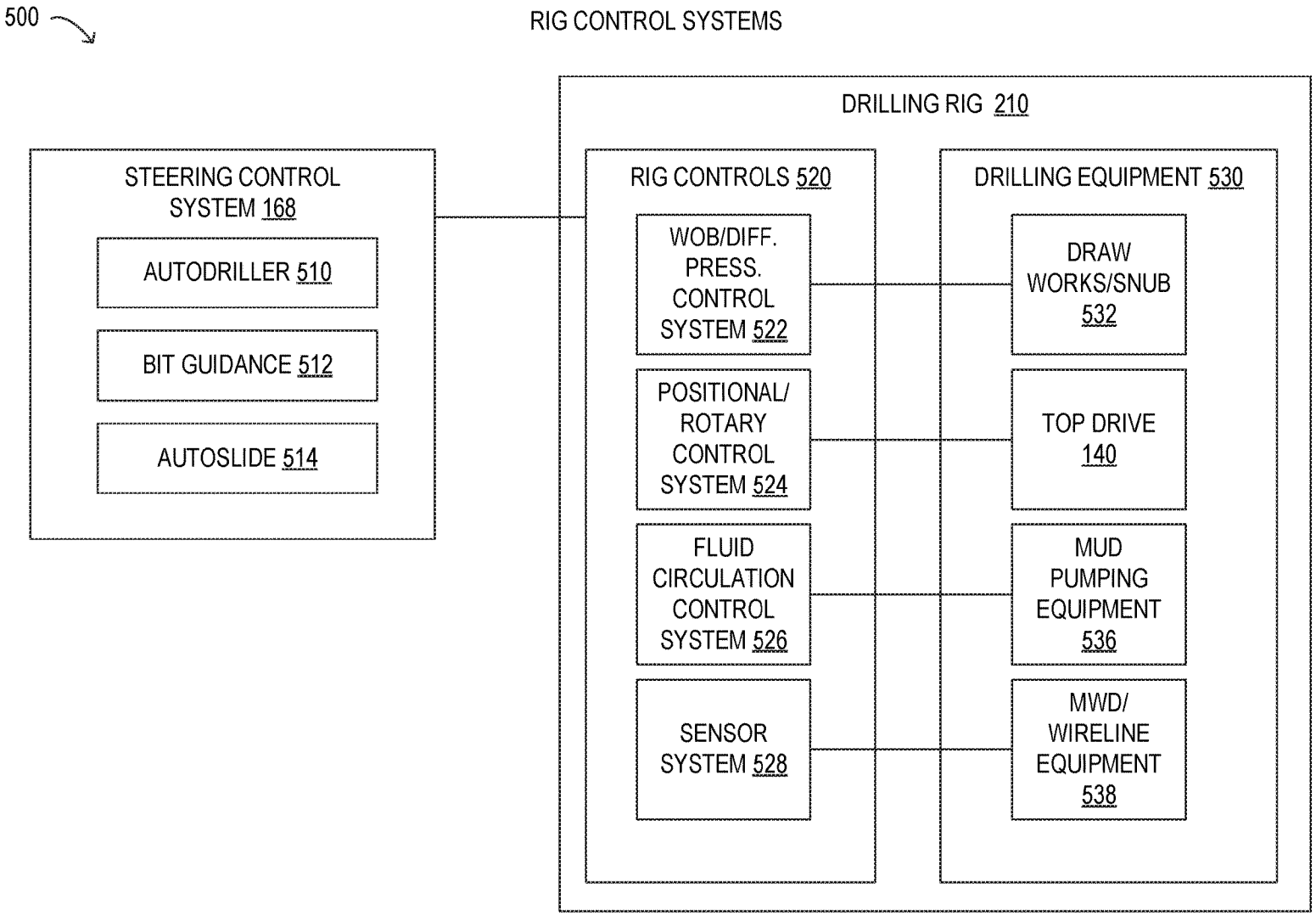
FIG. 5 is a depiction of rig control systems included in the drilling system.

Referring now to FIG. 5, an example of rig control systems 500 is illustrated in schematic form. It is noted that rig control systems 500 may include fewer or more elements than shown in FIG. 5 in different embodiments. As shown, rig control systems 500 includes steering control system 168 and drilling rig 210. Specifically, steering control system 168 is shown with logical functionality including an autodriller 510, a bit guidance 512, and an autoslide 514. Drilling rig 210 is hierarchically shown including rig controls 520, which provide secure control logic and processing capability, along with drilling equipment 530, which represents the physical equipment used for drilling at drilling rig 210. As shown, rig controls 520 include WOB/differential pressure control system 522, positional/rotary control system 524, fluid circulation control system 526, and sensor system 528, while drilling equipment 530 includes a draw works/snub 532, top drive 140, mud pumping equipment 536, and MWD/wireline equipment 538.

Figure 10:
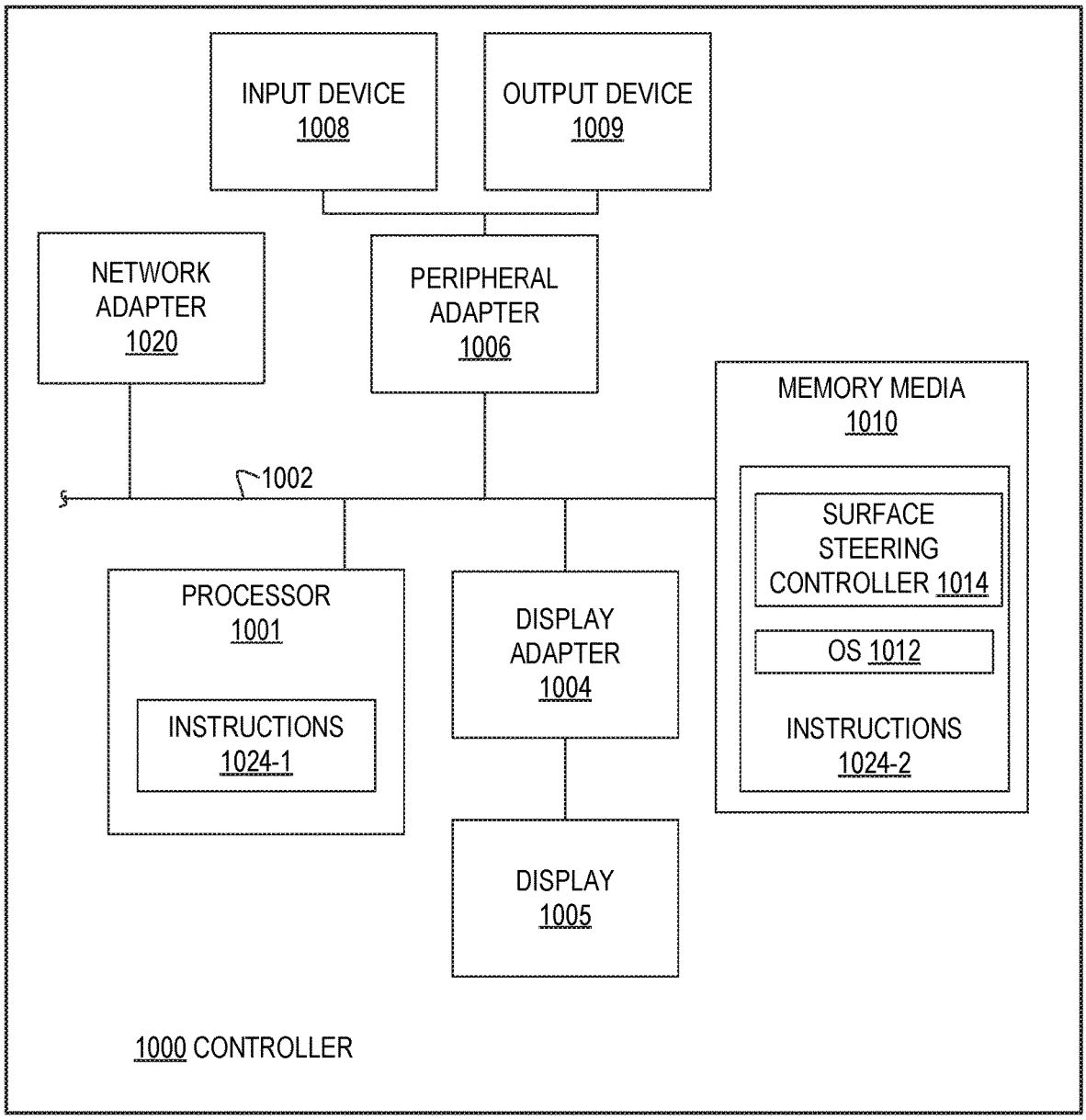
FIG. 10 is a depiction of a controller usable by the rig control systems.

Steering control system 168 represents an instance of a processor having an accessible memory storing instructions executable by the processor, such as an instance of controller 1000 shown in FIG. 10. Also, WOB/differential pressure control system 522, positional/rotary control system 524, and fluid circulation control system 526 may each represent an instance of a processor having an accessible memory storing instructions executable by the processor, such as an instance of controller 1000 shown in FIG. 10, but for example, in a configuration as a programmable logic controller (PLC) that may not include a user interface but may be used as an embedded controller. Accordingly, it is noted that each of the systems included in rig controls 520 may be a separate controller, such as a PLC, and may autonomously operate, at least to a degree. Steering control system 168 may represent hardware that executes instructions to implement a surface steerable system that provides feedback and automation capability to an operator, such as a driller. For example, steering control system 168 may cause autodriller 510, bit guidance 512 (also referred to as a bit guidance system (BGS)), and autoslide 514 (among others, not shown) to be activated and executed at an appropriate time during drilling. In particular implementations, steering control system 168 may be enabled to provide a user interface during drilling, such as the user interface 850 depicted and described below with respect to FIG. 8. Accordingly, steering control system 168 may interface with rig controls 520 to facilitate manual, assisted manual, semi-automatic, and automatic operation of drilling equipment 530 included in drilling rig 210. It is noted that rig controls 520 may also accordingly be enabled for manual or user-controlled operation of drilling, and may include certain levels of automation with respect to drilling equipment 530.

In rig control systems 500 of FIG. 5, WOB/differential pressure control system 522 may be interfaced with draw works/snubbing unit 532 to control WOB of drill string 146. Positional/rotary control system 524 may be interfaced with top drive 140 to control rotation of drill string 146. Fluid circulation control system 526 may be interfaced with mud pumping equipment 536 to control mud flow and may also receive and decode mud telemetry signals. Sensor system 528 may be interfaced with MWD/wireline equipment 538, which may represent various BHA sensors and instrumentation equipment, among other sensors that may be downhole or at the surface.

In rig control systems 500, autodriller 510 may represent an automated rotary drilling system and may be used for controlling rotary drilling. Accordingly, autodriller 510 may enable automate operation of rig controls 520 during rotary drilling, as indicated in the drill plan. Bit guidance 512 may represent an automated control system to monitor and control performance and operation drilling bit 148.

In rig control systems 500, autoslide 514 may represent an automated slide drilling system and may be used for performing slide drilling, including for initiating, controlling, and completing slide drilling. Accordingly, autoslide 514 may enable automated operation of rig controls 520 during a slide, and may return control to steering control system 168 for rotary drilling at an appropriate time, such as indicated in the drill plan. In particular implementations, autoslide 514 may be enabled to provide a user interface during slide drilling to specifically monitor and control the slide. For example, autoslide 514 may rely on bit guidance 512 for orienting a toolface and on autodriller 510 to set WOB or control rotation or vibration of drill string 146.

Figure 6:
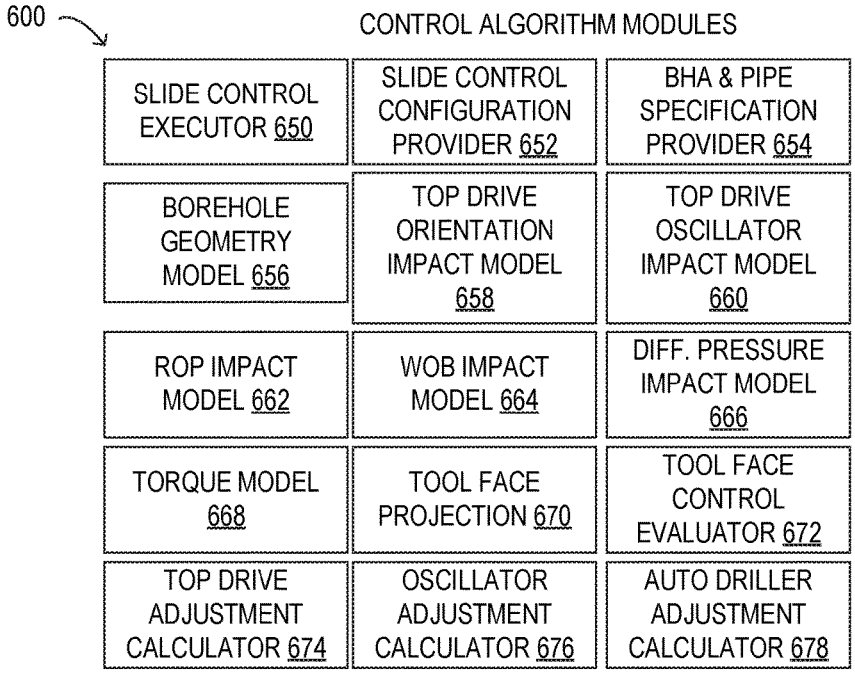
FIG. 6 is a depiction of algorithm modules used by the rig control systems.

FIG. 6 illustrates one embodiment of control algorithm modules 600 used with steering control system 168. The control algorithm modules 600 of FIG. 6 include: a slide control executor 650 that is responsible for managing the execution of the slide control algorithms; a slide control configuration provider 652 that is responsible for validating, maintaining, and providing configuration parameters for the other software modules; a BHA & pipe specification provider 654 that is responsible for managing and providing details of BHA 149 and drill string 146 characteristics; a borehole geometry model 656 that is responsible for keeping track of the borehole geometry and providing a representation to other software modules; a top drive orientation impact model 658 that is responsible for modeling the impact that changes to the angular orientation of top drive 140 have had on the toolface control; a top drive oscillator impact model 660 that is responsible for modeling the impact that oscillations of top drive 140 has had on the toolface control; an ROP impact model 662 that is responsible for modeling the effect on the toolface control of a change in ROP or a corresponding ROP set point; a WOB impact model 664 that is responsible for modeling the effect on the toolface control of a change in WOB or a corresponding WOB set point; a differential pressure impact model 666 that is responsible for modeling the effect on the toolface control of a change in differential pressure (DP) or a corresponding DP set point; a torque model 668 that is responsible for modeling the comprehensive representation of torque for surface, downhole, break over, and reactive torque, modeling impact of those torque values on toolface control, and determining torque operational thresholds; a toolface control evaluator 672 that is responsible for evaluating all factors impacting toolface control and whether adjustments need to be projected, determining whether realignment off-bottom is indicated, and determining off-bottom toolface operational threshold windows; a toolface projection 670 that is responsible for projecting toolface behavior for top drive 140, the top drive oscillator, and auto driller adjustments; a top drive adjustment calculator 674 that is responsible for calculating top drive adjustments resultant to toolface projections; an oscillator adjustment calculator 676 that is responsible for calculating oscillator adjustments resultant to toolface projections; and an autodriller adjustment calculator 678 that is responsible for calculating adjustments to autodriller 510 resultant to toolface projections.

Figure 7:
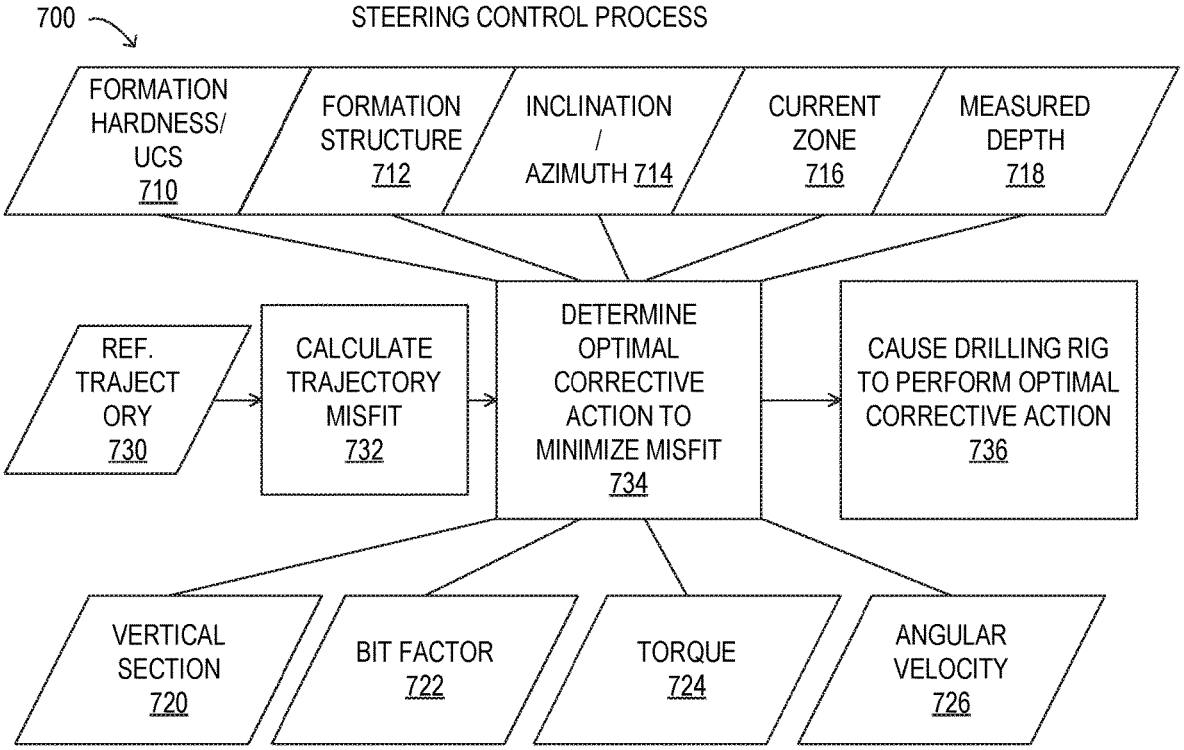
FIG. 7 is a depiction of a steering control process used by the rig control systems.

FIG. 7 illustrates one embodiment of a steering control process 700 for determining an optimal corrective action for drilling. Steering control process 700 may be used for rotary drilling or slide drilling in different embodiments.

Steering control process 700 in FIG. 7 illustrates a variety of inputs that can be used to determine an optimum corrective action. As shown in FIG. 7, the inputs include formation hardness/unconfined compressive strength (UCS) 710, formation structure 712, inclination/azimuth 714, current zone 716, MD 718, desired toolface 730, vertical section 720, bit factor 722, mud motor torque 724, reference trajectory 730, and angular velocity 726. It is noted that fewer or more inputs may be used in various embodiments. In FIG. 7, reference trajectory 730 of borehole 106 is determined to calculate a trajectory misfit in a step 732. Step 732 may output the trajectory misfit to determine an optimal corrective action to minimize the misfit at step 734, which may be performed using the other inputs described above. Then, at step 736, the drilling rig is caused to perform the optimal corrective action.

It is noted that in some implementations, at least certain portions of steering control process 700 may be automated or performed without user intervention, such as using rig control systems 700 (see FIG. 7). In other implementations, the optimal corrective action in step 736 may be provided or communicated (by display, SMS message, email, or otherwise) to one or more human operators, who may then take appropriate action. The human operators may be members of a rig crew, which may be located at or near drilling rig 210, or may be located remotely from drilling rig 210.

Figure 8:
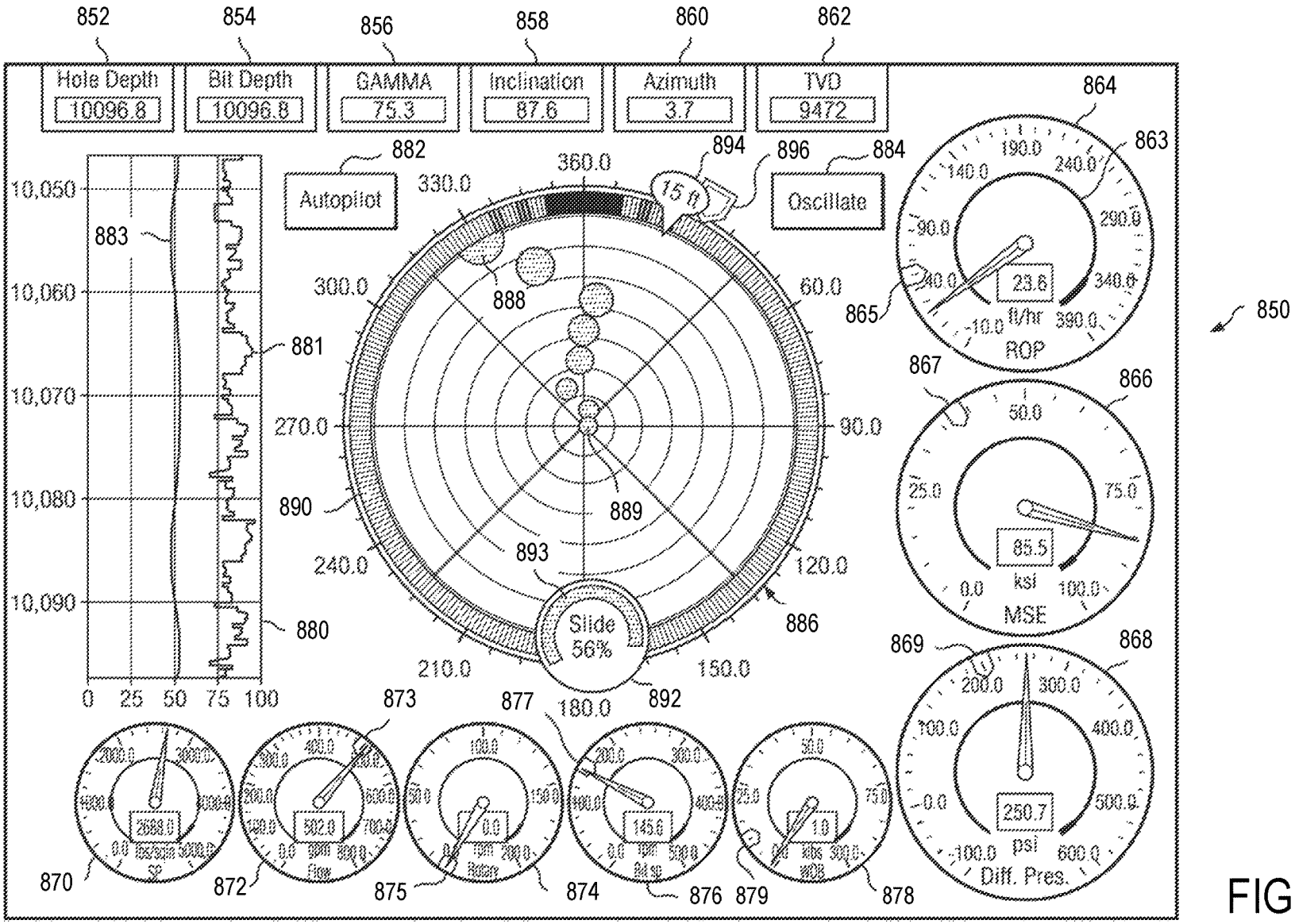
FIG. 8 is a depiction of a graphical user interface provided by the rig control systems.

Referring to FIG. 8, one embodiment of a user interface 850 that may be generated by steering control system 168 for monitoring and operation by a human operator is illustrated. User interface 850 may provide many different types of information in an easily accessible format. For example, user interface 850 may be shown on a computer monitor, a television, or a viewing screen (e.g., a display device) associated with steering control system 168. In some embodiments, at least certain portions of user interface 850 may be displayed to and operated by a user of steering control system 168 on a mobile device, such as a tablet or a smartphone (see also FIG. 10). For example, steering control system 168 may support mobile applications that enable user interface 850, or other user interfaces, to be used on the mobile device, for example, within a vicinity of drilling rig 210.

As shown in FIG. 8, user interface 850 provides visual indicators such as a hole depth indicator 852, a bit depth indicator 854, a GAMMA indicator 856, an inclination indicator 858, an azimuth indicator 860, and a TVD indicator 862. Other indicators may also be provided, including a ROP indicator 864, a mechanical specific energy (MSE) indicator 866, a differential pressure indicator 868, a standpipe pressure indicator 870, a flow rate indicator 872, a rotary RPM (angular velocity) indicator 874, a bit speed indicator 876, and a WOB indicator 878.

In FIG. 8, at least some of indicators 864, 866, 868, 870, 872, 874, 876, and 878 may include a marker representing a target value. For example, markers may be set as certain given values, but it is noted that any desired target value may be used. Although not shown, in some embodiments, multiple markers may be present on a single indicator. The markers may vary in color or size. For example, ROP indicator 864 may include a marker 865 indicating that the target value is 50 feet/hour (or 15 m/h). MSE indicator 866 may include a marker 867 indicating that the target value is 37 ksi (or 255 MPa). Differential pressure indicator 868 may include a marker 869 indicating that the target value is 200 psi (or 1,378 kPa). ROP indicator 864 may include a marker 865 indicating that the target value is 50 feet/hour (or 15 m/h). Standpipe pressure indicator 870 may have no marker in the present example. Flow rate indicator 872 may include a marker 873 indicating that the target value is 500 gpm (or 31.5 L/s). Rotary RPM indicator 874 may include a marker 875 indicating that the target value is 0 RPM (e.g., due to sliding). Bit speed indicator 876 may include a marker 877 indicating that the target value is 150 RPM. WOB indicator 878 may include a marker 879 indicating that the target value is 10 klbs (or 4,500 kg). Each indicator may also include a colored band, or another marking, to indicate, for example, whether the respective gauge value is within a safe range (e.g., indicated by a green color), within a caution range (e.g., indicated by a yellow color), or within a danger range (e.g., indicated by a red color).

In FIG. 8, a log chart 880 may visually indicate depth versus one or more measurements (e.g., may represent log inputs relative to a progressing depth chart). For example, log chart 880 may have a Y-axis representing depth and an X-axis representing a measurement such as GAMMA count 881 (as shown), ROP 883 (e.g., empirical ROP and normalized ROP), or resistivity. An autopilot button 882 and an oscillate button 884 may be used to control activity. For example, autopilot button 882 may be used to engage or disengage autodriller 510, while oscillate button 884 may be used to directly control oscillation of drill string 146 or to engage/disengage an external hardware device or controller.

In FIG. 8, a circular chart 886 may provide current and historical toolface orientation information (e.g., which way the bend is pointed). For purposes of illustration, circular chart 886 represents three hundred and sixty degrees. A series of circles within circular chart 886 may represent a timeline of toolface orientations, with the sizes of the circles indicating the temporal position of each circle. For example, larger circles may be more recent than smaller circles, so a largest circle 888 may be the newest reading and a smallest circle 889 may be the oldest reading. In other embodiments, circles 889, 888 may represent the energy or progress made via size, color, shape, a number within a circle, etc. For example, a size of a particular circle may represent an accumulation of orientation and progress for the period of time represented by the circle. In other embodiments, concentric circles representing time (e.g., with the outside of circular chart 886 being the most recent time and the center point being the oldest time) may be used to indicate the energy or progress (e.g., via color or patterning such as dashes or dots rather than a solid line).

In user interface 850, circular chart 886 may also be color coded, with the color coding existing in a band 890 around circular chart 886 or positioned or represented in other ways. The color coding may use colors to indicate activity in a certain direction. For example, the color red may indicate the highest level of activity, while the color blue may indicate the lowest level of activity. Furthermore, the arc range in degrees of a color may indicate the amount of deviation. Accordingly, a relatively narrow (e.g., thirty degrees) arc of red with a relatively broad (e.g., three hundred degrees) arc of blue may indicate that most activity is occurring in a particular toolface orientation with little deviation. As shown in user interface 850, the color blue may extend from approximately 22-337 degrees, the color green may extend from approximately 15-22 degrees and 337-345 degrees, the color yellow may extend a few degrees around the 13 and 345 degree marks, while the color red may extend from approximately 347-10 degrees. Transition colors or shades may be used with, for example, the color orange marking the transition between red and yellow or a light blue marking the transition between blue and green. This color coding may enable user interface 850 to provide an intuitive summary of how narrow the standard deviation is and how much of the energy intensity is being expended in the proper direction. Furthermore, the center of energy may be viewed relative to the target. For example, user interface 850 may clearly show that the target is at 90 degrees but the center of energy is at 45 degrees.

In user interface 850, other indicators, such as a slide indicator 892, may indicate how much time remains until a slide occurs or how much time remains for a current slide. For example, slide indicator 892 may represent a time, a percentage (e.g., as shown, a current slide may be 56% complete), a distance completed, or a distance remaining. Slide indicator 892 may graphically display information using, for example, a colored bar 893 that increases or decreases with slide progress. In some embodiments, slide indicator 892 may be built into circular chart 886 (e.g., around the outer edge with an increasing/decreasing band), while in other embodiments slide indicator 892 may be a separate indicator such as a meter, a bar, a gauge, or another indicator type. In various implementations, slide indicator 892 may be refreshed by autoslide 514.

In user interface 850, an error indicator 894 may indicate a magnitude and a direction of error. For example, error indicator 894 may indicate that an estimated drill bit position is a certain distance from the planned trajectory, with a location of error indicator 894 around the circular chart 886 representing the heading. For example, FIG. 8 illustrates an error magnitude of 15 feet and an error direction of 15 degrees. Error indicator 894 may be any color but may be red for purposes of example. It is noted that error indicator 894 may present a zero if there is no error. Error indicator may represent that drill bit 148 is on the planned trajectory using other means, such as being a green color. Transition colors, such as yellow, may be used to indicate varying amounts of error. In some embodiments, error indicator 894 may not appear unless there is an error in magnitude or direction. A marker 896 may indicate an ideal slide direction. Although not shown, other indicators may be present, such as a bit life indicator to indicate an estimated lifetime for the current bit based on a value such as time or distance.

It is noted that user interface 850 may be arranged in many different ways. For example, colors may be used to indicate normal operation, warnings, and problems. In such cases, the numerical indicators may display numbers in one color (e.g., green) for normal operation, may use another color (e.g., yellow) for warnings, and may use yet another color (e.g., red) when a serious problem occurs. The indicators may also flash or otherwise indicate an alert. The gauge indicators may include colors (e.g., green, yellow, and red) to indicate operational conditions and may also indicate the target value (e.g., an ROP of 100 feet/hour). For example, ROP indicator 868 may have a green bar to indicate a normal level of operation (e.g., from 10-300 feet/hour), a yellow bar to indicate a warning level of operation (e.g., from 300-360 feet/hour), and a red bar to indicate a dangerous or otherwise out of parameter level of operation (e.g., from 360-390 feet/hour). ROP indicator 868 may also display a marker at 100 feet/hour to indicate the desired target ROP.

Furthermore, the use of numeric indicators, gauges, and similar visual display indicators may be varied based on factors such as the information to be conveyed and the personal preference of the viewer. Accordingly, user interface 850 may provide a customizable view of various drilling processes and information for a particular individual involved in the drilling process. For example, steering control system 168 may enable a user to customize the user interface 850 as desired, although certain features (e.g., standpipe pressure) may be locked to prevent a user from intentionally or accidentally removing important drilling information from user interface 850. Other features and attributes of user interface 850 may be set by user preference. Accordingly, the level of customization and the information shown by the user interface 850 may be controlled based on who is viewing user interface 850 and their role in the drilling process.

Figure 9:
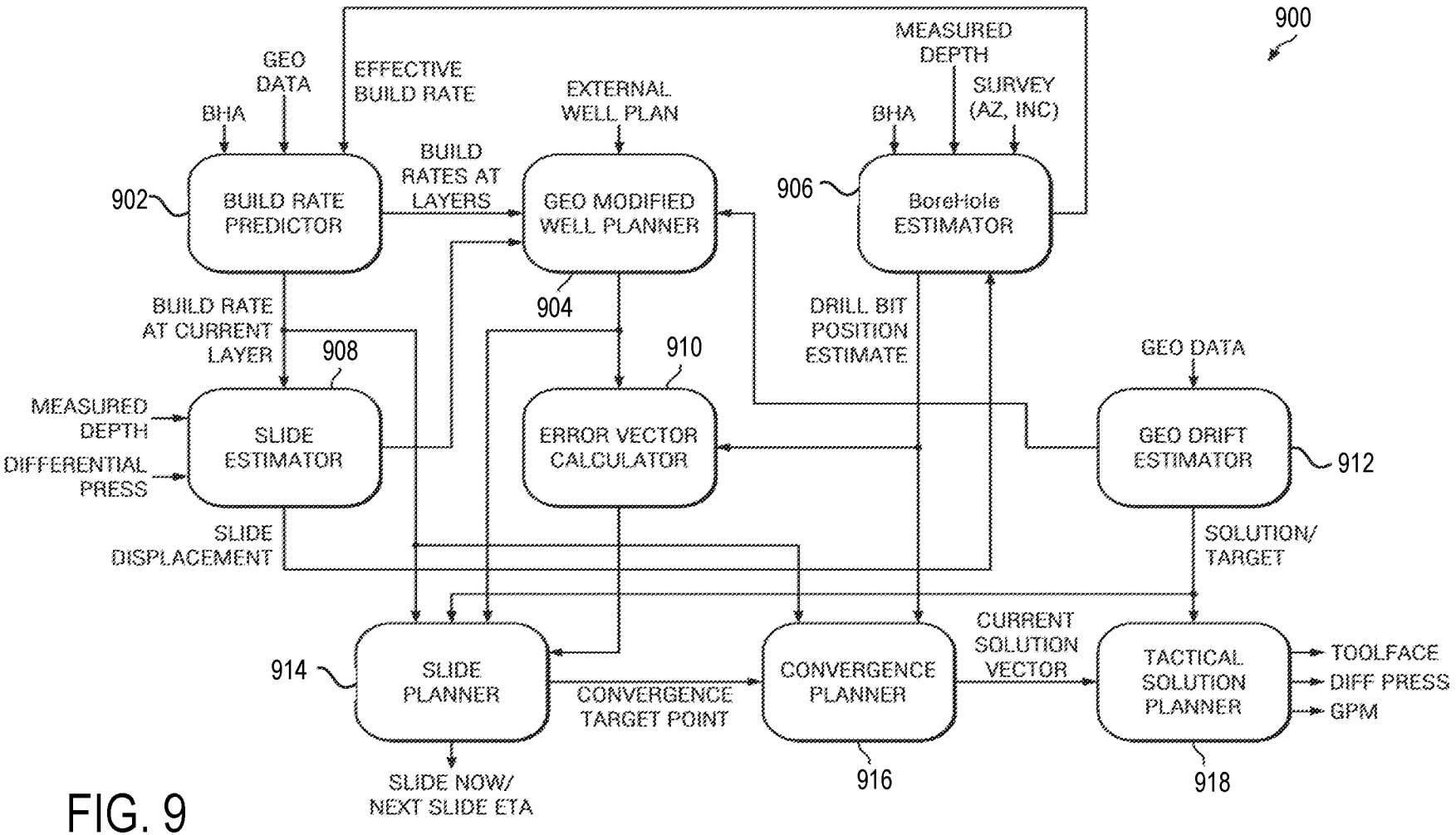
FIG. 9 is a depiction of a guidance control loop performed by the rig control systems.

Referring to FIG. 9, one embodiment of a guidance control loop (GCL) 900 is shown in further detail. GCL 900 may represent one example of a control loop or control algorithm executed under the control of steering control system 168. GCL 900 may include various functional modules, including a build rate predictor 902, a geo modified well planner 904, a borehole estimator 906, a slide estimator 908, an error vector calculator 910, a geological drift estimator 912, a slide planner 914, a convergence planner 916, and a tactical solution planner 918. In the following description of GCL 900, the term "external input" refers to input received from outside GCL 900, while "internal input" refers to input exchanged between functional modules of GCL 900.

In FIG. 9, build rate predictor 902 receives external input representing BHA information and geological information, receives internal input from the borehole estimator 906, and provides output to geo modified well planner 904, slide estimator 908, slide planner 914, and convergence planner 916. Build rate predictor 902 is configured to use the BHA information and geological information to predict drilling build rates of current and future sections of borehole 106. For example, build rate predictor 902 may determine how aggressively a curve will be built for a given formation with BHA 149 and other equipment parameters.

In FIG. 9, build rate predictor 902 may use the orientation of BHA 149 to the formation to determine an angle of attack for formation transitions and build rates within a single layer of a formation. For example, if a strata layer of rock is below a strata layer of sand, a formation transition exists between the strata layer of sand and the strata layer of rock. Approaching the strata layer of rock at a 90 degree angle may provide a good toolface and a clean drill entry, while approaching the rock layer at a 45 degree angle may build a curve relatively quickly. An angle of approach that is near parallel may cause drill bit 148 to skip off the upper surface of the strata layer of rock. Accordingly, build rate predictor 902 may calculate BHA orientation to account for formation transitions. Within a single strata layer, build rate predictor 902 may use the BHA orientation to account for internal layer characteristics (e.g., grain) to determine build rates for different parts of a strata layer. The BHA information may include bit characteristics, mud motor bend setting, stabilization and mud motor bit to bend distance. The geological information may include formation data such as compressive strength, thicknesses, and depths for formations encountered in the specific drilling location. Such information may enable a calculation-based prediction of the build rates and ROP that may be compared to both results obtained while drilling borehole 106 and regional historical results (e.g., from the regional drilling DB 412) to improve the accuracy of predictions as drilling progresses. Build rate predictor 902 may also be used to plan convergence adjustments and confirm in advance of drilling that targets can be achieved with current parameters.

In FIG. 9, geo modified well planner 904 receives external input representing a drill plan, internal input from build rate predictor 902 and geo drift estimator 912, and provides output to slide planner 914 and error vector calculator 910. Geo modified well planner 904 uses the input to determine whether there is a more optimal trajectory than that provided by the drill plan, while staying within specified error limits.

More specifically, geo modified well planner 904 takes geological information (e.g., drift) and calculates whether another trajectory solution to the target may be more efficient in terms of cost or reliability. The outputs of geo modified well planner 904 to slide planner 914 and error vector calculator 910 may be used to calculate an error vector based on the current vector to the newly calculated trajectory and to modify slide predictions. In some embodiments, geo modified well planner 904 (or another module) may provide functionality needed to track a formation trend. For example, in horizontal wells, a geologist may provide steering control system 168 with a target inclination as a set point for steering control system 168 to control. For example, the geologist may enter a target to steering control system 168 of 90.5-91.0 degrees of inclination for a section of borehole 106. Geo modified well planner 904 may then treat the target as a vector target, while remaining within the error limits of the original drill plan. In some embodiments, geo modified well planner 904 may be an optional module that is not used unless the drill plan is to be modified. For example, if the drill plan is marked in steering control system 168 as non-modifiable, geo modified well planner 904 may be bypassed altogether or geo modified well planner 904 may be configured to pass the drill plan through without any changes.

In FIG. 9, borehole estimator 906 may receive external inputs representing BHA information, measured depth information, survey information (e.g., azimuth and inclination), and may provide outputs to build rate predictor 902, error vector calculator 910, and convergence planner 916. Borehole estimator 906 may be configured to provide an estimate of the actual borehole and drill bit position and trajectory angle without delay, based on either straight line projections or projections that incorporate sliding. Borehole estimator 906 may be used to compensate for a sensor being physically located some distance behind drill bit 148 (e.g., 50 feet) in drill string 146, which makes sensor readings lag the actual bit location by 50 feet. Borehole estimator 906 may also be used to compensate for sensor measurements that may not be continuous (e.g., a sensor measurement may occur every 100 feet). Borehole estimator 906 may provide the most accurate estimate from the surface to the last survey location based on the collection of survey measurements. Also, borehole estimator 906 may take the slide estimate from slide estimator 908 (described below) and extend the slide estimate from the last survey point to a current location of drill bit 148. Using the combination of these two estimates, borehole estimator 906 may provide steering control system 168 with an estimate of the drill bit's location and trajectory angle from which guidance and steering solutions can be derived. An additional metric that can be derived from the borehole estimate is the effective build rate that is achieved throughout the drilling process.

In FIG. 9, slide estimator 908 receives external inputs representing measured depth and differential pressure information, receives internal input from build rate predictor 902, and provides output to borehole estimator 906 and geo modified well planner 904. Slide estimator 908 may be configured to sample toolface orientation, differential pressure, MD, incremental movement, MSE, and other sensor feedback to quantify/estimate a deviation vector and progress while sliding.

Traditionally, deviation from the slide would be predicted by a human operator based on experience. The operator would, for example, use a long slide cycle to assess what likely was accomplished during the last slide. However, the results are generally not confirmed until the downhole survey sensor point passes the slide portion of the borehole, often resulting in a response lag defined by a distance of the sensor point from the drill bit tip (e.g., approximately 50 feet). Such a response lag may introduce inefficiencies in the slide cycles due to over/under correction of the actual trajectory relative to the planned trajectory.

In GCL 900, using slide estimator 908, each toolface update may be algorithmically merged with the average differential pressure of the period between the previous and current toolface readings, as well as the MD change during this period to predict the direction, angular deviation, and MD progress during the period. As an example, the periodic rate may be between 10 and 60 seconds per cycle depending on the toolface update rate of downhole tool 166. With a more accurate estimation of the slide effectiveness, the sliding efficiency can be improved. The output of slide estimator 908 may accordingly be periodically provided to borehole estimator 906 for accumulation of well deviation information, as well to geo modified well planner 904. Some or all of the output of the slide estimator 908 may be output to an operator, such as shown in the user interface 850 of FIG. 8.

In FIG. 9, error vector calculator 910 may receive internal input from geo modified well planner 904 and borehole estimator 906. Error vector calculator 910 may be configured to compare the planned well trajectory to an actual borehole trajectory and drill bit position estimate. Error vector calculator 910 may provide the metrics used to determine the error (e.g., how far off) the current drill bit position and trajectory are from the drill plan. For example, error vector calculator 910 may calculate the error between the current bit position and trajectory to the planned trajectory and the desired bit position. Error vector calculator 910 may also calculate a projected bit position/projected trajectory representing the future result of a current error.

In FIG. 9, geological drift estimator 912 receives external input representing geological information and provides outputs to geo modified well planner 904, slide planner 914, and tactical solution planner 918. During drilling, geological drift may occur as the particular characteristics of the geological formation affect the drilling direction. More specifically, there may be a trajectory bias that is contributed by the geological formation as a function of ROP and BHA 149. Geological drift estimator 912 is configured to provide a geological drift estimate as a vector that can then be used to calculate geological drift compensation parameters that can be used to offset the geological drift in a control solution.

In FIG. 9, slide planner 914 receives internal input from build rate predictor 902, geo modified well planner 904, error vector calculator 910, and geological drift estimator 912, and provides output to convergence planner 916 as well as an estimated time to the next slide. Slide planner 914 may be configured to evaluate a slide/drill ahead cost equation and plan for sliding activity, which may include factoring in BHA wear, expected build rates of current and expected formations, and the drill plan trajectory. During drill ahead, slide planner 914 may attempt to forecast an estimated time of the next slide to aid with planning. For example, if additional lubricants (e.g., fluorinated beads) are indicated for the next slide, and pumping the lubricants into drill string 146 has a lead time of 30 minutes before the slide, the estimated time of the next slide may be calculated and then used to schedule when to start pumping the lubricants. Functionality for a loss circulation material (LCM) planner may be provided as part of slide planner 914 or elsewhere (e.g., as a stand-alone module or as part of another module described herein). The LCM planner functionality may be configured to determine whether fluids or additives or both should be pumped into the borehole based on indications such as flow-in versus flow-back measurements (see also FIGS. 11 and 13). For example, if drilling through a porous rock formation, fluid being pumped into the borehole may get lost in the rock formation. To address this issue, the LCM planner may control pumping LCM into the borehole to clog up the holes in the porous rock surrounding the borehole to establish a more closed-loop control system for the fluid.

In FIG. 9, slide planner 914 may also look at the current position relative to the next tubular connection, such as a pipe connection. A tubular connection may happen every 90 to 100 feet (or some other distance or distance range based on the particulars of the drilling operation) and slide planner 914 may avoid planning a slide when close to a tubular connection or when the slide would carry through the tubular connection. For example, if the slide planner 914 is planning a 50 foot slide but only 20 feet remain until the next tubular connection, slide planner 914 may calculate the slide starting after the next tubular connection and make any changes to the slide parameters to accommodate waiting to slide until after the next tubular connection. Such flexible implementation avoids inefficiencies that may be caused by starting the slide, stopping for the tubular connection, and then having to reorient the toolface before finishing the slide. During slides, slide planner 914 may provide some feedback as to the progress of achieving the desired goal of the current slide. In some embodiments, slide planner 914 may account for reactive torque in the drill string. More specifically, when rotating is occurring, there is a reactional torque wind up in drill string 146. When the rotating is stopped, drill string 146 unwinds, which changes toolface orientation and other parameters. When rotating is started again, drill string 146 starts to wind back up. Slide planner 914 may account for the reactional torque so that toolface references are maintained, rather than stopping rotation and then trying to adjust to an optimal toolface orientation. While not all downhole tools may provide toolface orientation when rotating, using one that does supply such information for GCL 900 may significantly reduce the transition time from rotating to sliding.

In FIG. 9, convergence planner 916 receives internal inputs from build rate predictor 902, borehole estimator 906, and slide planner 914, and provides output to tactical solution planner 918. Convergence planner 916 is configured to provide a convergence plan when the current drill bit position is not within a defined margin of error of the planned well trajectory. The convergence plan represents a path from the current drill bit position to an achievable and optimal convergence target point along the planned trajectory. The convergence plan may take account the amount of sliding/drilling ahead that has been planned to take place by slide planner 914. Convergence planner 916 may also use BHA orientation information for angle of attack calculations when determining convergence plans as described above with respect to build rate predictor 902. The solution provided by convergence planner 916 defines a new trajectory solution for the current position of drill bit 148. The solution may be immediate without delay, or planned for implementation at a future time that is specified in advance.

In FIG. 9, tactical solution planner 918 receives internal inputs from geological drift estimator 912 and convergence planner 916, and provides external outputs representing information such as toolface orientation, differential pressure, and mud flow rate. Tactical solution planner 918 is configured to take the trajectory solution provided by convergence planner 916 and translate the solution into control parameters that can be used to control drilling rig 210. For example, tactical solution planner 918 may convert the solution into settings for control systems 522, 524, and 526 to accomplish the actual drilling based on the solution. Tactical solution planner 918 may also perform performance optimization to optimizing the overall drilling operation as well as optimizing the drilling itself (e.g., how to drill faster).

Other functionality may be provided by GCL 900 in additional modules or added to an existing module. For example, there is a relationship between the rotational position of the drill pipe on the surface and the orientation of the downhole toolface. Accordingly, GCL 900 may receive information corresponding to the rotational position of the drill pipe on the surface. GCL 900 may use this surface positional information to calculate current and desired toolface orientations. These calculations may then be used to define control parameters for adjusting the top drive 140 to accomplish adjustments to the downhole toolface in order to steer the trajectory of borehole 106.

For purposes of example, an object-oriented software approach may be utilized to provide a class-based structure that may be used with GCL 900 or other functionality provided by steering control system 168. In GCL 900, a drilling model class may be defined to capture and define the drilling state throughout the drilling process. The drilling model class may include information obtained without delay. The drilling model class may be based on the following components and sub-models: a drill bit model, a borehole model, a rig surface gear model, a mud pump model, a WOB/differential pressure model, a positional/rotary model, an MSE model, an active drill plan, and control limits. The drilling model class may produce a control output solution and may be executed via a main processing loop that rotates through the various modules of GCL 900. The drill bit model may represent the current position and state of drill bit 148. The drill bit model may include a three dimensional (3D) position, a drill bit trajectory, BHA information, bit speed, and toolface (e.g., orientation information). The 3D position may be specified in north-south (NS), east-west (EW), and true vertical depth (TVD). The drill bit trajectory may be specified as an inclination angle and an azimuth angle. The BHA information may be a set of dimensions defining the active BHA. The borehole model may represent the current path and size of the active borehole. The borehole model may include hole depth information, an array of survey points collected along the borehole path, a gamma log, and borehole diameters. The hole depth information is for current drilling of borehole 106. The borehole diameters may represent the diameters of borehole 106 as drilled over current drilling. The rig surface gear model may represent pipe length, block height, and other models, such as the mud pump model, WOB/differential pressure model, positional/rotary model, and MSE model. The mud pump model represents mud pump equipment and includes flow rate, standpipe pressure, and differential pressure. The WOB/differential pressure model represents draw works or other WOB/differential pressure controls and parameters, including WOB. The positional/rotary model represents top drive or other positional/rotary controls and parameters including rotary RPM and spindle position. The active drill plan represents the target borehole path and may include an external drill plan and a modified drill plan. The control limits represent defined parameters that may be set as maximums and/or minimums. For example, control limits may be set for the rotary RPM in the top drive model to limit the maximum RPMs to the defined level. The control output solution may represent the control parameters for drilling rig 210.

Each functional module of GCL 900 may have behavior encapsulated within a respective class definition. During a processing window, the individual functional modules may have an exclusive portion in time to execute and update the drilling model. For purposes of example, the processing order for the functional modules may be in the sequence of geo modified well planner 904, build rate predictor 902, slide estimator 908, borehole estimator 906, error vector calculator 910, slide planner 914, convergence planner 916, geological drift estimator 912, and tactical solution planner 918. It is noted that other sequences may be used in different implementations.

In FIG. 9, GCL 900 may rely on a programmable timer module that provides a timing mechanism to provide timer event signals to drive the main processing loop. While steering control system 168 may rely on timer and date calls driven by the programming environment, timing may be obtained from sources other than system time. In situations where it may be advantageous to manipulate the clock (e.g., for evaluation and testing), a programmable timer module may be used to alter the system time. For example, the programmable timer module may enable a default time set to the system time and a time scale of 1.0, may enable the system time of steering control system 168 to be manually set, may enable the time scale relative to the system time to be modified, or may enable periodic event time requests scaled to a requested time scale.

Referring now to FIG. 10, a block diagram illustrating selected elements of an embodiment of a controller 1000 for performing surface steering according to the present disclosure. In various embodiments, controller 1000 may represent an implementation of steering control system 168. In other embodiments, at least certain portions of controller 1000 may be used for control systems 510, 512, 514, 522, 524, and 526 (see FIG. 5).

In the embodiment depicted in FIG. 10, controller 1000 includes processor 1001 coupled via shared bus 1002 to storage media collectively identified as memory media 1010.

Controller 1000, as depicted in FIG. 10, further includes network adapter 1020 that interfaces controller 1000 to a network (not shown in FIG. 10). In embodiments suitable for use with user interfaces, controller 1000, as depicted in FIG. 10, may include peripheral adapter 1006, which provides connectivity for the use of input device 1008 and output device 1009. Input device 1008 may represent a device for user input, such as a keyboard or a mouse, or even a video camera. Output device 1009 may represent a device for providing signals or indications to a user, such as loudspeakers for generating audio signals.

Controller 1000 is shown in FIG. 10 including display adapter 1004 and further includes a display device 1005. Display adapter 1004 may interface shared bus 1002, or another bus, with an output port for one or more display devices, such as display device 1005. Display device 1005 may be implemented as a liquid crystal display screen, a computer monitor, a television or the like. Display device 1005 may comply with a display standard for the corresponding type of display. Standards for computer monitors include analog standards such as video graphics array (VGA), extended graphics array (XGA), etc., or digital standards such as digital visual interface (DVI), definition multimedia interface (HDMI), among others. A television display may comply with standards such as NTSC (National Television System Committee), PAL (Phase Alternating Line), or another suitable standard. Display device 1005 may include an output device 1009, such as one or more integrated speakers to play audio content, or may include an input device 1008, such as a microphone or video camera.

In FIG. 10, memory media 1010 encompasses persistent and volatile media, fixed and removable media, and magnetic and semiconductor media. Memory media 1010 is operable to store instructions, data, or both. Memory media 1010 as shown includes sets or sequences of instructions 1024-2, namely, an operating system 1012 and surface steering controller 1014. Operating system 1012 may be a UNIX or UNIX-like operating system, a Windows® family operating system, or another suitable operating system. Instructions 1024 may also reside, completely or at least partially, within processor 1001 during execution thereof. It is further noted that processor 1001 may be configured to receive instructions 1024-1 from instructions 1024-2 via shared bus 1002. In some embodiments, memory media 1010 is configured to store and provide executable instructions for executing GCL 900, as mentioned previously, among other methods and operations disclosed herein.

As noted previously, steering control system 168 may support the display and operation of various user interfaces, such as in a client/server architecture. For example, surface steering controller 1014 may be enabled to support a web server for providing the user interface to a web browser client, such as on a mobile device or on a personal computer device. In another example, surface steering controller 1014 may be enabled to support an app server for providing the user interface to a client app, such as on a mobile device or on a personal computer device. It is noted that in the web server or the app server architecture, surface steering controller 1014 may handle various communications to rig controls 520 while simultaneously supporting the web browser client or the client app with the user interface.

Geosteering

As used herein, "geosteering" refers to an optimal placement of a borehole of a well (also referred to as a "wellbore"), such as borehole 106, with respect to a target formation or a specified portion of a target formation. The objective of geosteering is usually to keep a directional wellbore within a hydrocarbon target area for a maximum distance in order to maximize production from the well. In mature target areas, geosteering may be used to keep a wellbore in a particular section of a reservoir to minimize gas or water breakthrough, as well as to maximize economic production from the well.

In the process of drilling a borehole, as described previously, geosteering may also comprise adjusting the drill plan during drilling. The adjustments to the drill plan in geosteering may be based on geological information measured while drilling and correlation of the measured geological information with a geological model. The job of the directional driller is then to react to changes in the drill plan provided by geosteering, and to follow the latest drill plan.

A downhole tool used with geosteering will typically have azimuthal and inclination sensors, along with a GR sensor. Other logging options may include neutron density, resistivity, look-ahead seismic, downhole pressure readings, among others. A large volume of downhole data may be generated, especially by imaging tools, such that the data transmitted during drilling to the surface 104 via mud pulse and electromagnetic telemetry may be a selected fraction of the total generated downhole data. The downhole data that is not transmitted to the surface 104 may be stored downhole in a memory, such as in downhole tool 166, and may be uploaded from the memory and decoded once downhole tool 166 is at the surface 104. The uploading of the downhole data at the surface 104 may be transmitted to remote locations from drilling rig 210 (see also FIG. 4).

Drilling Mud Analysis and Control

As technological advancements in drilling occur, various aspects of the drilling process may become at least partially automated, to improve efficiency and reliability of various functions that have typically been performed manually by humans. Increased automation may also provide new synergy or capabilities that were previously not or poorly integrated, such as due to manual operations that do not lend themselves to automation, or due to improved outcomes from the use of more data in a faster manner than human operators can handle.

For example, rig control systems 500, and steering control system 168 in particular, may become increasingly integrated and may support new fields of automation that were previously not considered for integration. This technological integration and automation of various aspects of drilling wells may enable drilling operations to essentially become repeatable manufacturing processes, which is economically desirable in the drilling industry.

One aspect of the drilling process that is typically manually performed by humans is the processing of drilling mud 153 used for drilling. For example, as discussed above with respect to FIG. 5, drilling equipment 530 includes mud pumping equipment 536 to control mud flow and may also receive and decode mud telemetry signals. Thus, mud pumping 546 may represent the various equipment to introduce, circulate, and control pumping of drilling mud 153 into borehole 106 during drilling. As further described above with respect to FIG. 1, mud pumping equipment 536 may include various elements depicted with respect to drilling system 100, such as mud pit 154, mud pump 152, discharge line 156, standpipe 160, and rotary hose 158, among others. It is noted that drilling system 100 depicts an exemplary embodiment of drilling mud processing and that various systems and methods may be used for circulating drilling mud 153 into borehole 106 for drilling purposes.

As drilling mud 153 is circulated, including when circulated to the surface 104, drilling mud 153 may contain various information that is relevant to the drilling process. For example, a physical condition of drilling mud 153, such as color, hydrocarbon content, rock content, particulate content, thickness, etc., may be indicative of the formation being drilled. In addition, certain physical or chemical properties of drilling mud 153, such as temperature, viscosity, density, resistivity, GR count, alkalinity or acidity (pH), chemical composition, etc., may be characteristic of the geological formation, but also of the effect of various drilling parameters used to drill through the geological formation. For these reasons, an analysis of drilling mud 153 may be performed at the surface 104 to ascertain valuable information about the actual state of drilling that is occurring at drill bit 148.

The analysis of drilling mud 153 typically involves analysis of rock cuttings, fluids, hydrocarbons, and other material that has been carried to the surface 104 by drilling mud 153, usually from the bottom or end of borehole 106 where drilling is being performed. During drilling operations, drilling mud 153 travels downhole in borehole 106 until drilling mud 153 reaches drill bit 148. Drill bit 148 grinds into geological formation 102, which results in rock cuttings and other drilling byproducts being introduced into drilling mud 153. By virtue of the pressure applied to drilling mud 153 at the surface 104, drilling mud 153 is then forced back to the surface 104, along with the rock cuttings and drilling byproducts, among other materials from borehole 106. When drilling mud 153 arrives at the surface 104 in a typical drilling operation, a human geologist may manually examine samples of drilling mud 153 in order to provide a characterization of drilling mud 153 to report back to the drilling operator. For example, the human geologist may manually perform microscopy on the samples of drilling mud 153 to better observe the microcontents, such as particulates and various other content in drilling mud 153. In particular, the human geologist may look for rock cuttings, gas and oil content, different types of rocks, and the presence of various chemicals in drilling mud 153. However, the human geologist's findings about drilling mud 153 may be subjective and interpretive, and may be primarily based on the professional experience of the human geologist. Typically, a report of the human geologist's findings may be provided to the drilling operator, who may use the report on drilling mud 153, among other information, for modifying the drill path or for adjusting other aspects of the drilling operation. The findings in the report may also be recorded, such as in a mud log that may be indexed to a particular depth, which may be TVD, MD, or some other depth value.

The manual analysis of drilling mud 153 by the human geologist during drilling described above may have several disadvantages. First, the human geologist's report may not be captured in electronic form suitable for process integration, and may simply be kept using paper logs or text documents, which may not be accessible by existing hardware or software used for automation, such as by steering control system 168. Second, the human geologist's report may become available after a substantial delay has passed, which may reduce the effectiveness of any action taken by the drilling operator based on the report. For example, the delay may encompass a pumping time for transporting drilling mud 153 from drill bit 148 to the surface 104, an analysis time for inspecting the content in drilling mud 153, and a reporting time for generating the report and sending the report to the drilling operator. For example, the pumping time itself may take hours for drilling mud 153 to rise from a 20,000-foot deep borehole 106 from drill bit 148 to the surface 104, such that the additional delays from the analysis time and the reporting time may further aggravate the pumping time delay. Furthermore, a manually generated report on the condition of the drilling mud may be difficult or impossible to integrate with process data that are collected for the well, such as drilling parameters and survey data of the formation being drilled through.

As disclosed herein, a system and method for analysis and control of drilling mud 153 and additives may enable process integration and automation during drilling of a well, such as borehole 106. The system and method for analysis and control of drilling mud and additives disclosed herein may be integrated with and controlled by steering control system 168, as described above. The system and method for analysis and control of drilling mud and additives disclosed herein may enable automatic sampling and analysis of drilling mud 153 during drilling, such as by using a mud analysis system. The system and method for analysis and control of drilling mud and additives disclosed herein may enable qualitative or quantitative results of the analysis of drilling mud 153 to be provided to, and interpreted by, steering control system 168. The system and method for analysis and control of drilling mud and additives disclosed herein may enable steering control system 168, based on the results of the analysis, to determine various actions and responses to the analyzed condition of drilling mud 153. The system and method for analysis and control of drilling mud and additives disclosed herein may enable steering control system 168 to display indications of the composition and timing of drilling mud 153 during drilling. The system and method for analysis and control of drilling mud and additives disclosed herein may enable steering control system 168 to receive user input to control the composition and timing of additives to be added to drilling mud 153 during drilling. The system and method for analysis and control of drilling mud and additives disclosed herein may determine a composition of additives and a timing of adding the additives to drilling mud 153. The system and method for analysis and control of drilling mud and additives disclosed herein may be enabled to automatically mix a composition of additives for drilling mud 153 from a plurality of additives, such as by using a mud additive system. The system and method for analysis and control of drilling mud and additives disclosed herein may be enabled to automatically dose an additive into drilling mud 153 during drilling, such as by using the mud additive system.

The system and method for analysis and control of drilling mud and additives disclosed herein may provide feedback about drilling operations without delay during drilling. The feedback provided by the system and method for analysis and control of drilling mud and additives disclosed herein may include confirmation or early detection of drilling into or out of a geological formation, or of geological formation transitions (either in the vertical direction or in the horizontal direction), as well as information indicative of downhole tool health, such as through analysis of rubber or ferrous metals content (e.g., wear byproducts of tool steel) in drilling mud 153. The system and method for analysis and control of drilling mud and additives disclosed herein may aid in the placement of a downhole tool in borehole 106. The system and method for analysis and control of drilling mud and additives disclosed herein may provide measurement of the density and the viscosity of drilling mud 153 that can provide an early warning for mud loss changes or the presence of natural gas. The system and method for analysis and control of drilling mud and additives disclosed herein may enable early detection of, and thus, potential mitigation of, drilling through undesirable geological formations. For example, ashbeds are a type of geological formation in which drill bit 148 may often become stuck. Instead of conventional methods of mud analysis, such a manual examination of drilling mud 153 and its contents by a human geologist using a microscope, the system and method for analysis and control of drilling mud and additives disclosed herein may enable automatic identification and early detection of the ashbed, in order to report the presence of the ashbed as early as possible to the driller, in order to give the driller more time and more options to respond, such as by avoiding the ashbed. The system and method for analysis and control of drilling mud and additives disclosed herein may further provide digital mud logs that can be correlated with gamma ray logs and drilling parameter logs, such as according to MD. The various correlated logs, including the digital mud logs, may enable improved accuracy in determining an actual drilling location, such a location of drill bit 148 relative to a given formation, as well as improved accuracy of other drilling information. The system and method for analysis and control of drilling mud and additives disclosed herein may integrate analysis results from the mud analysis system as feedback into a drilling and geosteering control loop, such as GCL 900 described above with respect to FIG. 9.

Figure 11:
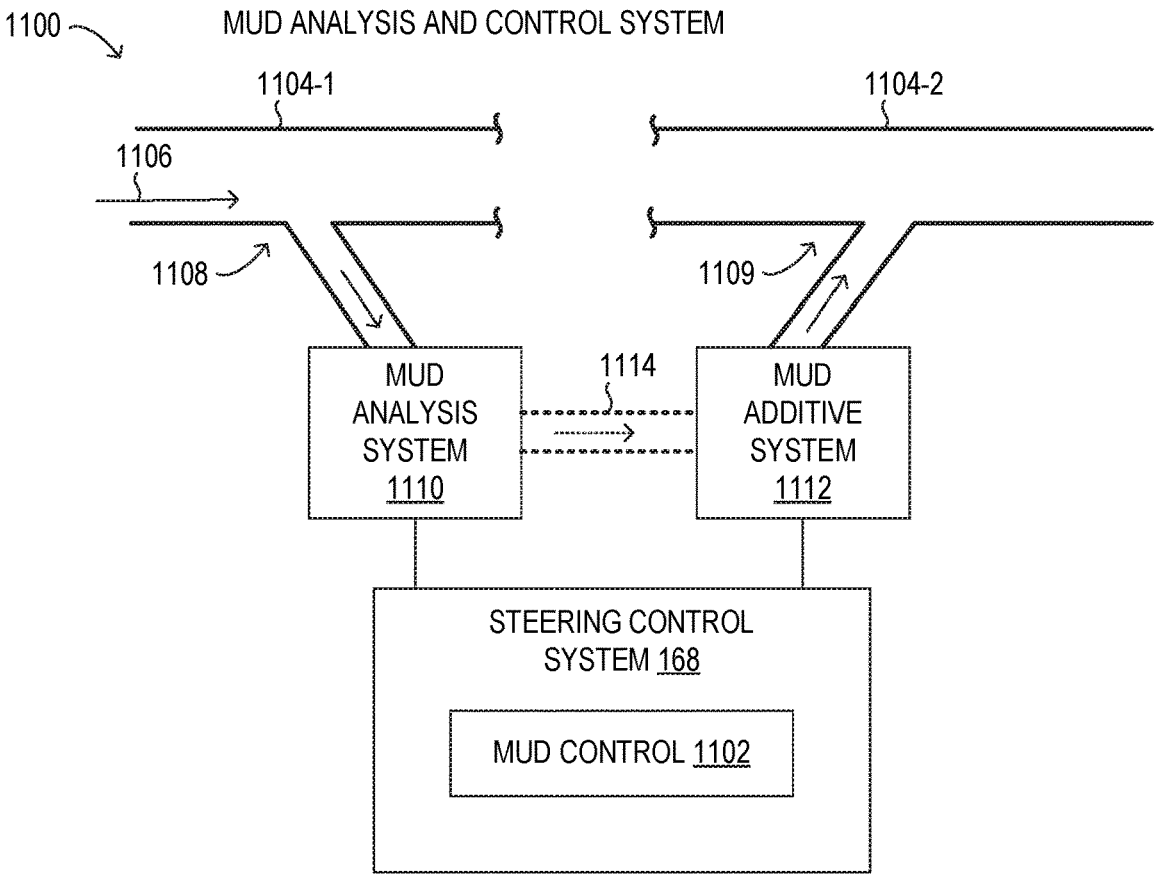
FIG. 11 is a depiction of a mud analysis and control system.

Referring now to FIG. 11, a mud analysis and control system 1100 is depicted. As shown in FIG. 11, mud analysis and control system 1100 is depicted in schematic form for descriptive clarity, and is not drawn to scale or perspective. It is noted that various elements not shown in FIG. 11 may be incorporated into mud analysis and control system 1100 in various embodiments. In FIG. 11, various elements in mud analysis and control system 1100 are shown operating in fluid communication with a mud line 1104 having drilling mud 153 passing therethrough in a direction 1106. It is noted that mud line 1104 may represent any of various mud lines or connections that are included in mud pumping equipment 536 (see FIG. 5), such as a conduit to or from mud pit 154, discharge line 156, or a conduit associated with mud pump 152 (see FIG. 1), among others. Accordingly, mud analysis and control system 1100 may be variously integrated with mud pumping equipment 536. Also shown with mud analysis and control system 1100 is steering control system 168, which is shown including a mud control 1102, which may be a hardware or software module for performing various operations associated with the system and method for analysis and control of drilling mud and additives disclosed herein (see also FIGS. 14 and 15). For example, mud control 1102 may receive and interpret signals from mud analysis system 1110 that are indicative of properties of drilling mud 153, such as properties determined by one or more of the sensors included with mud analysis system 1110. Additionally, mud control 1102 may send commands to control a mud additive system 1112 that may be enabled to mix and dose specific compositions of additives into drilling mud 153 (see also FIG. 13). Accordingly, because mud control 1102 is integrated with steering control system 168 in a similar manner as autodriller 510, bit guidance 512, and autoslide 514 (see FIG. 5), steering control system 168 may be enabled to perform various analyses and decision-making regarding drilling parameters, including evaluating various drilling information associated with borehole 106, in addition to, or in coordination with, mud analysis and control, as described herein. Additionally, it is noted that steering control system 168 may be enabled to display indications of the composition and timing of drilling mud 153 during drilling, as well as to receive user input to control the composition and timing of additives to be added to drilling mud 153 during drilling. For example, user interface 850 (see FIG. 8) provided by steering control system 168 may include with display elements indicating a condition of drilling mud 153, or a measurement value associated with drilling mud 153, such as on a log plot versus MD or another depth. User interface 850 provided by steering control system 168 may also include user input elements, such as to control the composition of drilling mud 153 at a desired time. For example, user input elements may be available for operation using user interface 850 that enable a user to specify various properties of an additive to be added to drilling mud 154, such as by mud additive system 1112, including particle size, density, composition, delivery timing, among other options.

The timing of the additives to drilling mud 153 may be accordingly controlled using various factors that steering control system 168 can access and evaluate. In one example, steering control system 168 may send a request to mud additive system 1112 specifying a composition and a future time to add a given additive to drilling mud 153. In response, mud additive system 1112 may be enabled to prepare and mix the composition of the additive and to add the additive having the mixed composition when the future time occurs. In another example, the request may specify a drilling operation that is planned to occur after a minimum delay period from when the request was sent. Then, as steering control system 168 controls drilling to perform the drilling operation, mud additive system 1112 may be enabled or controlled to add the additive within a specified time in advance of the planned drilling operation. The minimum delay period may be longer than the specified time in advance of the planned drilling operation to allow for sufficient time for the additive to reach drill bit 148. In some embodiments, the additive may be a lubricant, such as PTFE beads, while the drilling operation is a slide. In a third example, the minimum delay period may be determined by steering control system 168 from at least one of the following: ROP, WOB, differential pressure, a rotational velocity of drill bit 148, MD, a mud flow rate; the drill plan; and a threshold delay value.

In addition, the timing of sampling drilling mud 153 by mud analysis system 1110 may be controlled in a variety of ways. In one example, a time-based approach may be used, such as at regular or irregular intervals for sampling drilling mud 153, or at predetermined times. In some embodiments, the intervals may be adapted by steering control system 168 depending on various factors associated with drilling, such as a value of a drilling parameter, or a condition of drilling mud 153. In another example, a volume-based approach may be used, such as sampling drilling mud 153 according to a given volume of drilling mud 153 that has been circulated, such as every 1,000 gallons, among other values. In another example, sampling of drilling mud 153 may be based on MD of borehole 106, such as at regular intervals, irregular intervals, or at specified values of MD.

In FIG. 11, mud analysis and control system 1100 includes a mud analysis system 1110 that is enabled to receive a circulating supply of drilling mud 153 at a diversion 1108 in fluid communication with mud line 1104-1, which may represent an arbitrary first section of mud line 1104. As shown mud line 1104-1 is a source of drilling mud 153 that is sampled by mud analysis system 1110. The location of mud line 1104-1 may vary and may represent different locations in mud pumping equipment 536. For example, mud line 1104-1 may be located to enable sampling of drilling mud 153 upon emerging from borehole 106. In another example, mud line 1104-1 may be located to enable sampling of drilling mud 153 entering or leaving mud pit 154 or mud supply tank 1312. In yet another example, mud line 1104-1 may be located to enable sampling of drilling mud 153 entering borehole 106. Other locations for mud line 1104-1 may also be used. In this manner, an absolute or a relative condition of drilling mud 153 at a given location may be compared to the remaining supply of drilling mud 153, as sampled in a variety of locations.

Although depicted as a Y-diversion, it is noted that diversion 1108 may be any of a variety of means for obtaining a characteristic mud sample from the flow in mud line 1104 in direction 1106, such as a bypass line to mud line 1104 or another sampling means. For example, mud analysis system 1110 may include a means for obtaining a desired mud sample from a closed mud conduit, from an open mud line, from mud pit 154, from mud supply tank 1312, or various combinations thereof. In some embodiments, the desired mud sample may be a sample of particulate matter that has been isolated from drilling mud 153, such as rock cuttings or metal shavings, for example. In some embodiments, mud analysis system 1110 may support receiving manually supplied mud samples, such as obtained from a human operator. In some embodiments, mud analysis system 1110 may return the drilling mud diverted at diversion 1108 using a return line 1114 (shown as an optional dashed element in FIG. 11) that may be in fluid communication with mud line 1104, such as via mud additive system 1112 as shown.

As described in further detail with respect to FIG. 12 below, mud analysis system 1110 may include a variety of sensors and sensory means for qualitatively and quantitatively analyzing drilling mud 153 flowing through mud line 1104. As noted, mud analysis system 1110 may include connections for receiving mud flow from diversion 1108, as well as internal connections and means for autosampling drilling mud 153 from diversion 1108, in order to operate the various sensors. Specifically, mud analysis system 1110 may include various mud connections, mud pumps and other mud handling equipment, as well as electronic connections for power and communications, such as network connections for communicating with steering control system 168, or more specifically, with mud control 1102.

One example of a mud analysis system that is enabled for similar analyses as mud analysis system 1110, and can analyze mud density and mud rheology is Halliburton's BaraLogix™ Density Rheology Unit. As disclosed herein, mud analysis system 1110 provides various additional sensors and is communicatively integrated with steering control system 168, such as by providing output signals (not shown) indicative of mud properties (see also FIG. 12). It is noted that the output signals may be in various analog or digital form, and may be direct or indirect signals. Direct signals may be directly communicated from mud analysis system 1110 to mud control 1102 in operation, such as by using an active network connection and without intermediate storage. Indirect signals may be transmitted using an intermediate storage, such as a database, and may be in the form of numerical values that are updated by mud analysis system 1110 in the database without direct communication with mud control 1102, in one example. The database for transmitting such indirect signals may be local to steering control system 168, or may be regional drilling DB 412, or central drilling DB 416 (see FIG. 4).

Furthermore, steering control system 168 (or mud control 1102) may be enabled to log information indicative of the output signals from mud analysis system 1110 as a mud log that can be indexed using MD, for example. Specifically, mud analysis system 1110 may enabled to correlate a sample of drilling mud 153 with the MD of borehole 106 using various different methods. In one example, mud analysis system 1110 may enabled to correlate a sample of drilling mud 153 with the MD of borehole 106 by comparing the first property with a drill plan for the well, by identifying a time of drilling from a first timestamp indicative of the output signal and a travel time of drilling mud 153 from the MD to the surface 104, by identifying a pressure of drilling mud 153 indicative of a velocity of drilling mud 153 from the MD to the surface 104, or various combinations thereof. It is noted that there can be a variable time delay for drilling mud 153 to travel to the surface 104 from a location in proximity to drill bit 148 in borehole 106. The variable time delay may be a function of a hole size of borehole 106 and a flow rate of drilling mud 153. In some embodiments, steering control system 168 may be coupled, directly or indirectly, with various components included with mud pumping, as shown previously with respect to FIG. 5, including components such as mud pumps, valves, pressure regulators, flow meters, among other mud handling components. Accordingly, steering control system 168 may be enabled to receive or acquire various process parameters associated with mud pumping equipment 536, such as flowrate, volumetric losses, BHA information, as well as borehole size and borehole geometry at various MDs, for example. With access to such process parameters associated with mud pumping equipment 536, steering control system 168 (or mud control 1102) may be enabled to associate various content of drilling mud 153 (e.g., cuttings, fluids, inclusions, particles, etc.) at the surface 104 to a location or a measured depth within borehole 106, from where a sample of drilling mud 153 originates.

Additionally, steering control system 168 (or mud control 1102) may invoke borehole estimator 906 (see FIG. 9) to map the measured depth to TVD without delay during drilling, for example. In this manner, logs of one or more mud properties may be combined with other logged well data, such as gamma ray data, drilling parameters, and drilling equipment parameters, such as MSE or a drift rate, among others, into a single log, display, or data file, which is desirable for predictive methods, drilling operations, and post-well analyses. The combined logged well data, including mud property logs, may also be used for pattern recognition to improve identification of geological formations, such as target area 280 in strata layer 272-1 or another strata layer (see FIG. 2), which may improve steering the drilling of the well. In one example, the combined logged well data, including mud property logs, may be provided to steering control system 168 for comparing the combined logged well data with a corresponding drill plan for the well, including data associated with one or more geological formations in the well. Alternatively, the mud property log may be correlated with one or more additional logs, such as a GR log among others, to help identify one or more geological formations of interest. For example, a result of the comparing may produce a match, or a correlation within a selected margin of error, to identify a particular geological formation. When the particular formation is identified, steering control system 168 may output a notification indicating that a match exists and may identify the determined formation, such as on a user interface displayed to a user. Additionally, steering control system 168, responsive to identifying the formation, may determine one or more suggested actions for drilling operations. For example, steering control system 168 may automatically adjust one or more drilling parameters based on the identified formation, such as modifying a slide drilling operation to reach target area 280, or to avoid an undesirable formation (e.g., an ash bed).

In one example, steering control system 168 may employ geosteering and may compare results of mud analyses performed by mud analysis system 1110 to a target drill path for borehole 106, such as specified in the drill plan. Depending on the results of the geosteering comparison in conjunction with the mud analyses performed by mud analysis system 1110, steering control system 168 may be enabled to alter the drill path of borehole 106 and may implement corresponding actions and changes in drilling parameters to implement the altered drill path. Accordingly, steering control system 168 may determine a location of drill bit 148 relative to a surrounding geological formation, and may know which geological formations are expected as drilling continues. Thus, steering control system 168 may use the mud analyses to determine whether drill bit 148 is in a desired formation, is in an undesired formation, is about to enter a desired formation, or is about to enter an undesired formation. The location of drill bit 148 determined by steering control system 168 may be a relative location with respect to a particular geological formation that is determined based on drilling parameters, such as ROP or an expected time period before drill bit 148 reaches a given formation boundary. When indicated, steering control system 168 may determine an appropriate corrective action (such as to cease drilling, commence a slide drilling operation, or change one or more drilling parameters), and then automatically drill in accordance with the determined corrective action, based on the results of the mud analyses by mud analysis system 1110, at least in part.

Although shown integrated with mud line 1104 in FIG. 11, which is located at the surface 104, it is noted that one or more sensors included with mud analysis system 1110 may be located downhole in borehole 106. For example, a downhole sensor included with mud analysis system 1110 may not receive drilling mud from diversion 1108, but rather, such a downhole sensor may directly measure a property of drilling mud 153 within borehole 106, such as in proximity to drill bit 148, among other locations along drill string 146. The downhole sensor may be communicatively coupled to mud analysis system 1110 or mud control 1102 (rather than directly measuring drilling mud 153 at surface 104) to provide signals indicative of downhole properties of drilling mud 153. Such a downhole measurement of various properties of drilling mud 153 may be advantageous, such as by eliminating potential sources of error that may be introduced as drilling mud 153 travels to the surface 104. In addition, a travel time for the signal from the downhole sensor to reach the surface 104, and be interpreted by mud control 1102, may be less than the delay involved with analyzing drilling mud 153 at the surface 104, which may be desirable for certain drilling control operations.

In FIG. 11, mud analysis and control system 1100 further includes mud additive system 1112, as noted. Mud additive system 1112 may be enabled to introduce additives into drilling mud 153 that circulates along drill string 146 in borehole 106. Accordingly, mud additive system 1112 may be enabled to prepare, dose, and supply one or more additives, such as in a desired composition or concentration, for adding to drilling mud 153 at a merge point 1109. As with diversion 1108, merge point 1109 is schematically depicted, and may represent any of a variety of means enabled to introduce solid, liquid, or mixed solid-liquid additives into drilling mud 153 flowing in direction 1106 in conduit 1104-2. It is noted that conduit portion 1104-2 may represent any arbitrary mud handling process location where introduction of additives using merge point 1109 is desired. It is noted that mud additive system 1112 may also be used to add a fresh supply of mud or other liquids, or to first dissolve one or more additives into a supply of fresh mud prior to introduction at merge point 1109. Further details of mud additive system 1112 are described below with respect to FIG. 13.

Also shown in FIG. 11 as a dashed element is return line 1114 that may optionally fluidically couple an output from mud analysis system 1110 to an input to mud additive system 1112. In some embodiments, return line 1114 may represent a portion of a bypass mud line to conduit 1104 within which a characteristic sample of drilling mud 153 is carried to mud analysis system 1110 and then flows to mud additive system 1112 before being reintroduced to conduit 1104-2 at merge point 1109. It is noted that mud analysis system 1110 may further include additional diversions (not shown) to obtain characteristic mud samples, while mud additive system 1112 may include additional merge points (not shown) to introduce one or more additives. In still other embodiments, it is noted that mud analysis and control system 1100 may be arranged with mud analysis system 1110 and mud additive system 1112 being in direct fluid communication with conduit 1104, such that diversion 1108 or merge point 1109 are not used. It is further noted that at least certain portions of mud analysis system 1110 may be placed downstream of mud additive system 1112, in order to validate or confirm the operation of mud additive system 1112, such as by using a sensor to analyze drilling mud 153 after merge point 1109 to confirm that a particular additive was indeed properly added to drilling mud 153 by mud additive system 1112.

Figure 12:
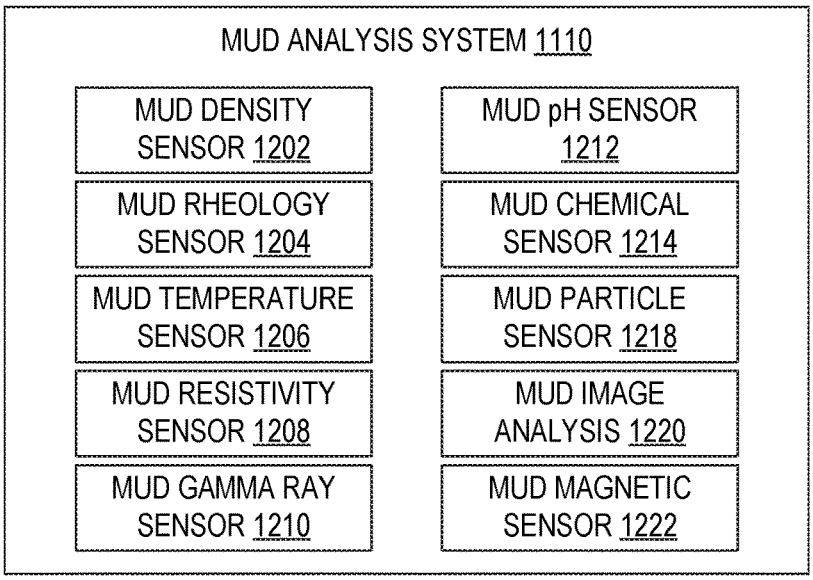
FIG. 12 is a depiction of a mud analysis system.

Referring now to FIG. 12, further details of mud analysis system 1110 are depicted. Specifically, FIG. 12 depicts a plurality of mud sensors and corresponding equipment that may be included with mud analysis system 1110. FIG. 12 is a schematic diagram for descriptive purposes and omits various implementation details for clarity. It is noted that each of the elements shown included with mud analysis system 1110 may be associated with mud sample handling equipment, as well as processing equipment enabled for measurement, control, and communication (not shown). For example, the processing equipment may include one or more processors with an accessible memory media that is enabled to execute instructions, such as instructions for acquiring measurements from a sensor included with mud analysis system 1110, instructions for controlling sample handling equipment, and instructions to communicate analysis results, such as measured values, to mud control 1102, among other instructions. Certain ones of the sensors depicted with mud analysis system 1110 in FIG. 12 may be located downhole in borehole 106, in addition to sensors that are located at the surface 104. For example, a mud temperature sensor 1206 may be located within downhole tool 166 and may communicate temperature values using mud pulse telemetry to steering control system 168 at the surface 104.

In FIG. 12, mud analysis system 1110 is depicted including a variety of analytical instruments and sensors that enable mud analysis system 1110 to provide a variety of information to steering control system 168. Specifically, as shown, mud analysis system 1110 includes a mud density sensor 1202 to measure the density (or the weight and volume) of mud contents and mud flow of drilling mud 153. As shown, mud analysis system 1110 also includes a mud rheology sensor 1204 that is enabled to determine viscosity and various related characteristic flow values of drilling mud 153. As shown, mud analysis system 1110 also includes mud temperature sensor 1206 that is enabled to measure temperature of drilling mud 153. As shown, mud analysis system 1110 also includes a mud resistivity sensor 1208 that is enabled to measure electrical resistivity, or related values such as impedance, of drilling mud 153. As shown, mud analysis system 1110 also includes a mud gamma ray sensor 1210 that is enabled to measure gamma ray emissions of drilling mud 153. As shown, mud analysis system 1110 also includes a mud pH sensor 1212 that is enabled to measure an alkalinity or an acidity of drilling mud 153. As shown, mud analysis system 1110 also includes a mud chemical sensor 1214 that is enabled to measure a chemical composition of drilling mud 153. As shown, mud analysis system 1110 also includes a mud particle sensor 1218 that is enabled to determine various characteristic properties of particulate matter in drilling mud 153. The characteristic properties of the particles can include size, shape, morphology, distribution, and concentration, among others. As shown, mud analysis system 1110 also includes a mud magnetic sensor 1222 that is enabled to determine magnetic susceptibility of the contents of drilling mud 153. For example, when the content of drilling mud 153 includes ferrous metals, mud magnetic sensor 1222 may be selectively enabled to identify the ferrous metal content.

As shown in FIG. 12, mud analysis system 1110 also includes a mud image analysis 1220 that may include various equipment for visually analyzing drilling mud 153, including performing image analysis of the contents in drilling mud 153. In various embodiments, mud image analysis 1220 may include a shaker table over which drilling mud 153 from diversion 1108 flows and is spread out over an area of the shaker table. The shaker table may be implemented as a conveyor system that constantly moves the sample of drilling mud 153 to enable a continuous analysis. As a result of the spreading out over the area of the shaker table, various inclusions and solid particles may become visible at the shaker table, which can be captured using a video camera to generate corresponding digital images, or frames of digital images, such as in a video. The digital images may be analyzed by mud image analysis 1220 using image processing techniques to identify and characterize the contents of drilling mud 153. The image processing operations accordingly that may be performed by mud image analysis 1220 may include identifying an individual particle from an image of the shaker table, and tracking the individual particle over time on the shaker table using a temporal-spatial-feature tracking algorithm. The image processing operations accordingly that may be performed by mud image analysis 1220 may also include measuring a size, a shape, or a velocity of the individual particle, and performing an analysis to determine whether a drilling action is indicated, based on a condition of drilling mud 153 determined from an image of the shaker table. A rate of flow of drilling mud 153 and an extent of coverage of drilling mud 153 over an area of the shaker table may be used to determine a rheological condition of drilling mud 153, such as the presence of excessive solids, too low viscosity, among other factors. Additionally, mud image analysis 1220 may be enabled to operate with various types of light, such as visible light, lasers, infrared, near-infrared, far-infrared, ultraviolet, coherent light, incoherent light, polarized light, radio waves, x-rays, among other types of light, photons, or electromagnetic radiation. Accordingly, mud image analysis system 1220 may be enabled to use light detection and ranging (LIDAR), thermal imaging, radar, or other techniques to analyze drilling mud 153 and contents.

Regardless of the technique used, the ongoing monitoring of the inclusions and solid particles in drilling mud 153 by mud analysis system 1110 may be used to ascertain various types of information regarding the drilling of borehole 1110. For example, a variance in the concentration of the inclusions and solid particles in drilling mud 153, or a variance in mud volume and mud pressure, as detected by mud analysis system 1110, may be indicative of a condition within borehole 106, such as borehole widening or a borehole obstruction, such as a hole cleaning condition that blocks or impedes a flow of drilling mud 153.

In operation, mud analysis system 1110 may be enabled to communicate with steering control system 168 to determine various parameters and settings associated with measurements of drilling mud 153 that are performed by mud analysis system 1110. For example, steering control system 168 may send mud analysis system 1110 information specifying which measurements are to be acquired, a frequency of the measurements, as well as a format of the measurements communicated back to steering control system 168 from mud analysis system 1110. In certain modes of operation, it is noted that steering control system 168 may enable the user to directly interact with mud analysis system 1110 on an ad hoc basis to perform desired analyses and to obtain corresponding measurements. In other modes of operation, steering control system 168 may enable a driller to oversee operation of mud analysis system 1110, after mud analysis system 1110 has been configured for continuous or semi-automatic operation, such as by using user interface 850 to view indications and update control values from time to time. For example, the user of steering control system 168 (e.g., the drilling operator) may specify frequent sampling of drilling mud 153 during certain drilling operations, while specifying that during other drilling operations the sampling of drilling mud 153 may be performed less frequently or deactivated altogether. Accordingly, steering control system 168 may command mud analysis system 1110 to control the frequency and type of analyses of drilling mud 153 that are to be performed during drilling. For example, steering control system 168 may instruct mud analysis system 1110 in advance to automatically vary the frequency of the analyses depending on a location of drilling or with respect to certain drilling operations.

It is noted that the individual sensor elements shown in FIG. 12 may represent a plurality of sensors that are either the same type or are different types. For example, the individual sensor elements depicted in FIG. 12 may encompass various equipment to perform various analytical techniques on drilling mud 153. Specifically, mud chemical sensor 1214 may incorporate equipment and subsystems to perform at least one of spectrographic analyses, chromatographic analyses, chemical reactions, optical absorption analyses, and optical transmission analyses, and may further be enabled to detect the presence of one or more chemicals or compounds in drilling mud 153, such as gas, oil, rubber, metal, and various hydrocarbons, among others. In this manner, mud chemical sensor 1214, alone or in conjunction with another sensor in mud analysis system 1110, may accordingly be enabled to detect wear and tear products from drill string 146 in drilling mud 153. In another example, mud density sensor 1202 may be enabled to perform at least one of x-ray diffraction density analyses, gamma ray density analyses, and flow density analyses, on drilling mud 153.

Figure 13:
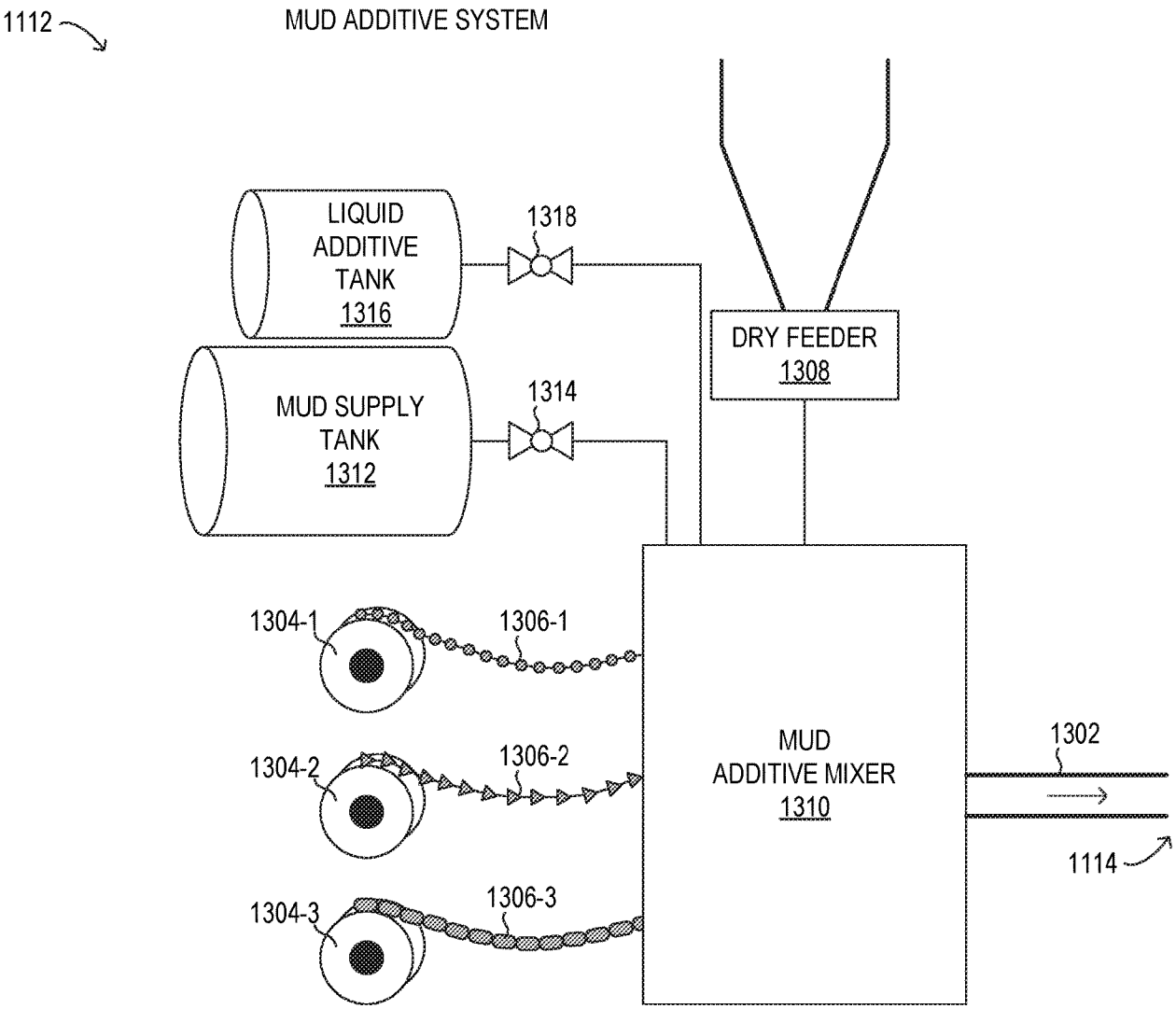
FIG. 13 is a depiction of a mud additive system.

Referring now to FIG. 13, further details of mud additive system 1112 are depicted. Specifically, FIG. 13 depicts different kinds of additives and corresponding equipment that may be included with mud additive system 1112. FIG. 13 is a schematic diagram for descriptive purposes and omits various implementation details for clarity. As shown, mud additive system 1112 includes a mud additive mixer 1310 that may be associated with additive processing equipment (not shown) and individual control systems for the additive processing equipment. For example, mud additive system 1112 or mud additive mixer 1310 may include one or more processors with an accessible memory media (not shown) that is enabled to execute instructions, such as instructions for controlling additive or mixing equipment, and instructions to receive commands to control the additive or mixing equipment, among other instructions. Mud additive system 1112 may be used to introduce additives into drilling mud 153 in a manner that is consistent, controlled, and safe. Mud additive system 1112 may include an automated delivery system for additives to be introduced into drilling mud 153 that achieves consistency, high feed rates, and process control to support various densities, particle sizes, and uniform distribution of the additives to be added to drilling mud 153. The automated delivery system included in mud additive system 1112 may also provide safety benefits by reducing manual handling and interactions with various additives that may include hazardous chemicals. The safety benefits may result from a decreased risk of injury from manually handling the hazardous chemicals, which may be present in bulk form in large quantities, as well as from manually handling the packaging of the additives and manually mixing the additives in batches. By removing or avoiding such manual operations associated with handling additives and packaging using the automated delivery system, the risks to human personnel may be reduced by the use of mud additive system 1112. The additive may be selected from any one or more of: a liquid, a colloid, a solid-liquid mixture, a solute dissolved in a solvent, a powder, and a particulate.

As shown in FIG. 13, mud additive system 1112 may be communicatively coupled to steering control system 168, such as by using a wired or a wireless network connection (see also FIG. 11). Accordingly, mud additive system 1112 is enabled to be responsive to control signals or commands received from steering control system 168. In some embodiments, mud additive system 1112 may be responsive to commands received from a human operator. The control signals or commands received by mud additive system 1112 from steering control system 168 may originate as a decision made by mud control 1102, or may be in response to user input. For example, from steering control system 168, the user may be provided user interface elements, such as on user interface 850, to select types and amounts of available additives to add to drilling mud 153, as well as user interface elements to specify the timing or rate of introduction of the additives to drilling mud 153. Thus, in addition to controlling the content and amount of the additives being added to drilling mud 153, mud additive system 1112 may control the timing of mixing a desired additive having a given composition, such as from other additives, and outputting the desired additive to merge point 1118 for mixing with drilling mud 153. It is noted that the timing of delivery of additives to drilling mud 153 may be an important factor for optimal drilling. For example, polytetrafluoroethylene (PTFE or Teflon™) beads may be used as an additive to lubricate drilling mud 153 during slide drilling. If the PTFE beads are delivered to drill bit 156 too early or too late with respect to the slide drilling, the PTFE beads may fail to lubricate the slide drilling as intended, which is undesirable for drilling purposes, but also because the cost and effort to introduce the lubricating PTFE beads is wasted. In one example, the user interface can enable the user to specify additive parameters such as fiber size, density, granular particulate size, and composition of a mixture of different additives or additive components, such as various chemical agents, bentonite, PTFE beads, among others. The user input provided to steering control system 168 may result in immediate dosing of the specified additives to drilling mud 153 without delay. The user input to steering control system 168 may also specify a delay or a timestamp in the future when the specified additives are to be added to drilling mud 153. In addition, the user input provided to steering control system 168 may specify certain process parameters, such as a feed rate, a chopper rate, among others, in order to control the size and consistency of individual additives to be added to drilling mud 153.

As shown in FIG. 13, mud additive system 1112 includes mud additive mixer 1310 having an output line 1302 that may couple to mud analysis and control system 1100 at merge point 1114. Also shown with mud additive system 1112 is a dry feeder 1308 that may be used as a feed line for dry material to be added to drilling mud 153, such as powders, fibers, particles, and various dry mixtures that can be gravitationally dispensed using a hopper, for example. The refilling of the hopper (or other storage means) of dry feeder 1308 may be manually performed, such as in response to a corresponding indication provided on user interface 850, or locally at mud additive system 1112. In other embodiments, additional equipment may be provided to automate a sufficient supply feed of a dry additive for dispensing by dry feeder 1308. Dry feeder 1308 may be an automated device that is enabled to volumetrically or gravitationally dispense quantities of the dry additive to mud additive mixer 1310. Although one instance of dry feeder 1308 is shown in FIG. 13 for descriptive clarity, it is noted that a plurality of dry feeders 1308 may be used, such as for a corresponding plurality of dry additives. Because dry feeder 1308 can precisely dispense quantitatively accurate amounts of the dry additive, dry feeder 1308 may be controlled to dispense a desired amount of the dry additive at a desired time.

In FIG. 13, also shown with mud additive system 1112 is a mud supply tank 1312, along with a control valve 1314. Mud supply tank 1312 may be used to supply fresh mud into drilling mud 153, such as when the circulating mud supply in borehole 106 is lost during drilling. Additionally, mud supply tank 1312 may be used to provide low concentrations of an additive, such when a predilution of the additive using the fresh mud from mud supply tank 1312 is indicated, prior to mixing with drilling mud 153. Control valve 1314 may be used to meter the output from mud supply tank 1312, and may accordingly be a servo-actuated valve, such as a ball valve for example. It is noted that mud supply tank 1312 can be a fixed structure, or can be a terrestrial pit, such as mud pit 154, while additional mud pumps and mud lines (not shown) may be used to provide the fresh mud to mud additive mixer 1310. Also shown with mud additive system 1112 is a liquid additive tank 1316, along with a control valve 1318. Liquid additive tank 1316 may bused to supply a liquid additive to mud additive mixer 1310 that can be controlled using control valve 1318. It is noted that although one liquid additive tank 1316 is shown for one liquid additive, a plurality of liquid additive tanks and control valves for a respective plurality of different or the same liquid additive may be used.

Also shown in FIG. 13 are packaged additives 1306 that can be supplied to mud additive mixer 1310. Packaged additives 1306 may represent certain substances that are packaged in small units for environmental stability and preservation prior to addition to drilling mud 153. Accordingly, the packaging used for packaged additives 1306 may protect the against moisture, temperature, water, air, oxygen, or otherwise prevent degradation from undesirable environments to ensure a desired efficacy when used in borehole 106. In some embodiments, the packaging used for packaged additives 1306 may itself may comprise a desired additive, such as one or more materials that are soluble in drilling mud 153, for example. It should be further appreciated that, in one aspect of the present disclosure, one or more packaged additives 1306 may be customized to be particularly useful for a particular type of well, a particular region in which the well is located, or for particular geological formations, among other criteria. In some embodiments, a particular well owner may specify the form and composition of packaged additives 1306 for use in borehole 106. It is noted that even when packaged additives 1306 are manually fed from feed spools 1304, the rope or cable form may itself be useful for standardizing the delivery of packaged additives 1306 to drilling mud 153, and may improve the consistency of the delivery.

As shown in FIG. 13, three different types of packaged additives 1306-1, 1306-2, and 1306-3 are depicted being respectively supplied as ropes or cables using feed spools 1304-1, 1304-2, 1304-3. Although three different kinds of packaged additives 1306 are depicted, it is noted that various numbers of packaged based additives 1306 may be supplied to mud additive mixer 1310. In FIG. 13, each packaged additive 1306 is shown with a different packaged form that may indicate a different composition, respectively. Although packaged additives 1306 are shown having discrete packages tied together, it will be understood that packaged additives 1306 may include a continuous form, such as a clear tube filled with the additive that may be dosed on the basis of length of the clear tube, for example. Other types of packaged additives (not shown) may be added in discrete form, such as blocks, sticks, bricks, rods, among other forms.

In addition, the orientation of feed spools 1304 shown in FIG. 13 is schematic and feed spools 1304 may be physically installed in various orientations. In various implementation, packaged additives 1306 may be servo mechanically fed to mud additive mixer 1310, such as by powering feed spools 1304 or using another means, and may enable precise quantitative dosing of packaged additives 1306, such as by controlling a feed rate of powered feed spools 1304. In addition, mud additive system 1112 may include one or more choppers or grinders (not shown) that may be enabled to decimate or separate individual portions of packaged additives 1306. In one example (not shown), packaged additives 1306 can be fed vertically into mud additive mixer 1310 using gravity feeding. In another embodiment, packaged additives 1306 may be fed to mud additive mixer 1310 using one or more powered rollers, or using the choppers or grinders in mud additive mixer 1310 feed packaged additives 1306. In mud additive system 1112, packaged additives 1306 may be mixed with liquid additives, dry additives, or drilling mud, among other types of liquid and solid mixtures that may be used.

With reference to FIG. 13, one particular kind of additive for drilling mud 153 is referred to as a loss circulation material (LCM). As drilling mud 153 is circulated into borehole 106 to reduce the friction and heat generated by the drill bit 148 working on the geological formation, under certain conditions, a certain amount of drilling mud 153 may seep into cracks in the geological formation. Drilling mud 153 seeping into the geological formation may result in undesirable loss of drilling mud 153 and may accordingly adversely affect drilling, such as by increasing the friction and heat at drill bit 148. To reduce the loss of drilling mud 153 into the geological formation, or other losses, various LCM may be added to drilling mud 153. The LCM in drilling mud 153 may seal off holes, cracks, or other openings in the geological formation, and may result in reduced loss of drilling mud 153. LCM compositions may vary from fibrous materials (e.g., tree bark and cane stalks) to granular materials (e.g., wood and nuts hulls). Typically, LCM is manually added by humans to drilling mud 153, which can result in significant inconsistencies, or errors that can damage costly drilling equipment. For example, if a mud line transporting drilling mud 153 becomes clogged due to improper or excessive addition of LCM, various drilling equipment may fail and the failure may result in an unexpected tripping that can add delay, expense and additional safety risks.

However, with the use of mud analysis and control system 1100, as shown and described with respect to FIGS. 11, 12 and 13, downhole or surface sensors can be used to monitor various properties of drilling mud 153 during drilling as various drilling operations and drilling parameters are being controlled. Then, for example, steering control system 168 may be enabled to detect significant changes to the condition and amount of drilling mud 153 being circulated during drilling without delay, such as by using mud analysis system 1110 as described previously herein. Once steering control system 168 detects an unsuitable condition of drilling mud 153, an indication may be transmitted or displayed to the user. The indication may be a communication, such as a message, a short-message service (SMS) message, an email, an audible alert, a visual alert (e.g., a colored indicator that can be red, blinking, yellow, or green, according to specified criteria). The unsuitable condition may be a significant loss of drilling mud 153, that may be indicated when the loss exceeds a predetermined amount. For example the loss may be indicated when a drilling parameter associated with drilling mud 153 exceeds a predetermined range of values, or another alarm condition occurs. In response to the indication of excessive loss of drilling mud 153, steering control system 168 may be enabled to control mud additive system 1112 to automatically or semi-automatically add large particles sizes of LCM to drilling mud 153 to pump downhole and seal the geological formation. Similarly, in response to an indication that a slide drilling operation is coming up soon (which can be based on time, MD, WOB, ROP, etc.), steering control system 168 may be enabled generate a corresponding user notification of the desirability of adding certain types of LCM to drilling mud 153 within a particular time window and in a particular amount. In this manner, steering control system 168 is enabled to improve the chances that the appropriate amount of LCM be added to drilling mud 153 in a timely manner. In other embodiments, steering control system 168 may automatically control mud additive system 1112 to automatically deliver a specified LCM to drilling mud 153 at a desired and preprogrammed start time and schedule. In particular embodiments, steering control system 168 may automatically control a feed rate and grinding operations for an LCM, such as by grinding the LCM for a longer period of time to obtain a smaller particle size of the LCM.

Figure 14:
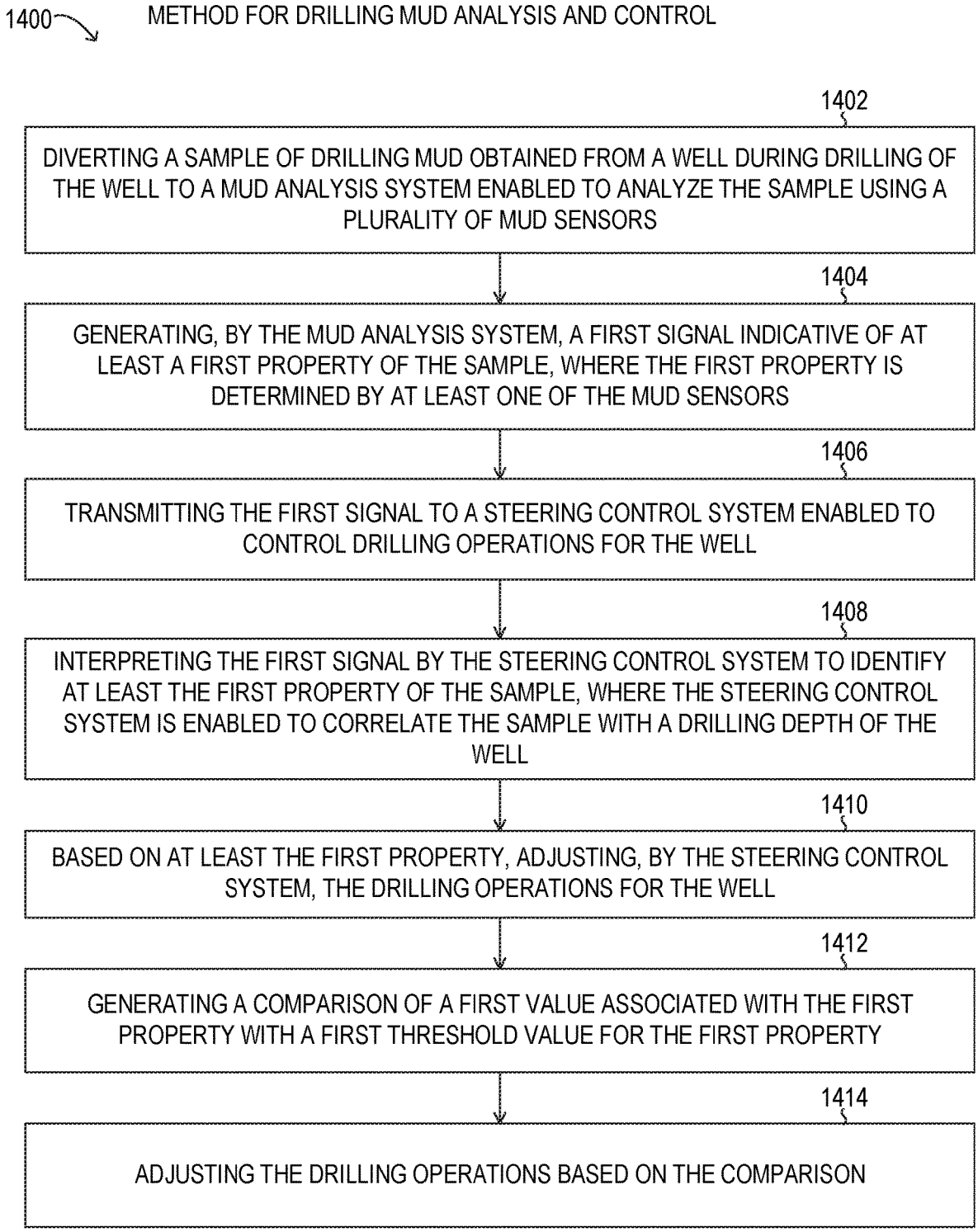
FIG. 14 is a flow chart of a method for drilling mud analysis and control.

Referring now to FIG. 14, a flowchart of an embodiment of a method 1400 for drilling mud analysis and control, as disclosed herein, is depicted. Method 1400 may be performed using mud analysis and control system 1100, as described above. It is noted that certain operations described in method 1400 may be optional or may be rearranged in different embodiments.

Method 1400 in FIG. 14 may begin at step 1402 by diverting a sample of drilling mud obtained from a well during drilling of the well to a mud analysis system enabled to analyze the sample using a plurality of mud sensors. At step 1404, the mud analysis system generates a first signal indicative of at least a first property of the sample, where the first property is determined by at least one of the mud sensors. At step 1406, the first signal is transmitted to a steering control system enabled to control drilling operations for the well. At step 1408, the first signal is interpreted by the steering control system to identify at least the first property of the sample, where the steering control system is enabled to correlate the sample with a MD of the well. Based on at least the first property, at step 1410, the steering control system adjusts the drilling operations for the well. At step 1412, a comparison of a first value associated with the first property is compared with a first threshold value for the first property. At step 1414, the drilling operations are adjusted based on the comparison.

Figure 15:
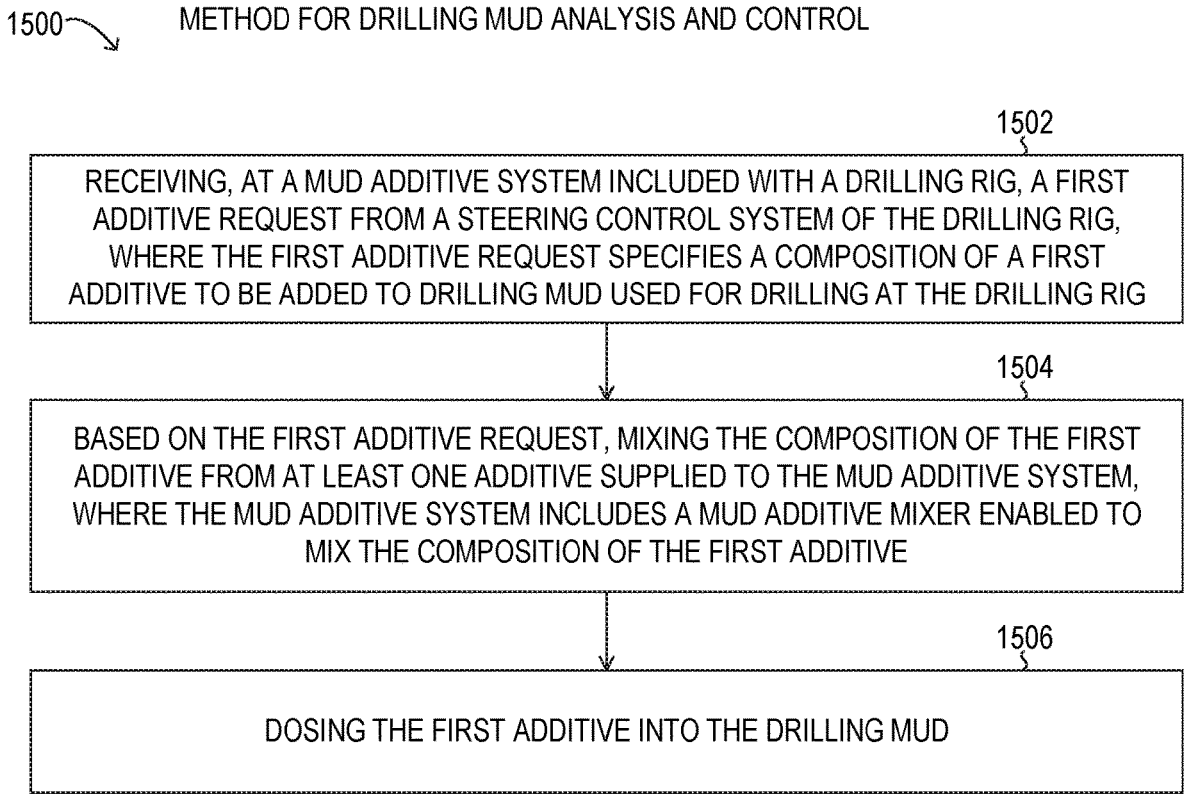
FIG. 15 is a flow chart of a method for drilling mud analysis and control.

Referring now to FIG. 15, a flowchart of an embodiment of a method 1500 for drilling mud analysis and control, as disclosed herein, is depicted. Method 1500 may be performed using mud analysis and control system 1100, as described above. It is noted that certain operations described in method 1500 may be optional or may be rearranged in different embodiments.

Method 1500 in FIG. 15 may begin at step 1502 by a mud additive system included with a drilling rig receiving a first additive request from a steering control system of the drilling rig, where the first additive request specifies a composition of a first additive to be added to drilling mud used for drilling at the drilling rig. Based on the first additive request, at step 1504, the composition of the first additive is mixed from at least one additive supplied to the mud additive system, where the mud additive system includes a mud additive mixer enabled to mix the composition of the first additive. At step 1506, the first additive is dosed into the drilling mud.

As disclosed herein, analysis and control of drilling mud and additives is disclosed using a mud analysis system and a mud additive system that may automatically monitor and control the drilling mud during drilling of a well. The mud analysis system may acquire measurements on a sample of the drilling mud during drilling, and may send signals indicative of the drilling mud to a steering control system enabled to control the drilling. The steering control system may receive user input or may make decisions regarding additives to be added to the drilling mud and the timing thereof. The mud additive system may be enabled to receive commands from the steering control system and mix and add additives to the drilling mud.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A drilling mud system, comprising:

a mud analysis system enabled for diverting a sample of drilling mud obtained from a well during drilling of the well to analyze the sample using a plurality of sensors;

a mud additive system enabled for adding a predetermined amount of drilling mud or an additive to the drilling mud circulated into the well; and a mud control system enabled for:

receiving an indication of the drilling mud from the sensors of the mud analysis system, wherein the indication is indicative of a first property of the sample, wherein the first property is determined by at least one of the sensors;

transmitting the indication of the drilling mud to a steering control system enabled for controlling a plurality of drilling parameters for the well;

generating a comparison of a first value associated with the first property with a first threshold value for the first property;

adjusting at least one of the drilling parameters based on the comparison, the at least one of a group of drilling parameters consisting of:

a rate of penetration (ROP);
a weight on bit (WOB);
a drilling rotational velocity (RPM);
a mud circulation rate;
a mud pressure; and
a direction of the well;

receiving a command from the steering control system indicating a first time and a first additive for adding to the drilling mud; and causing the mud additive system to add the first additive at the first time to the drilling mud.

2. The drilling mud system of claim 1, wherein the mud analysis system is enabled to analyze a plurality of samples, including the sample, at a predetermined time interval during drilling of the well.

3. The drilling mud system of claim 1, wherein the sensors further comprise at least one of a group consisting of:
a mud resistivity sensor;
a mud rheology sensor;
a mud temperature sensor;
a mud density sensor;
a mud gamma ray sensor;
a mud pH sensor;
a mud chemical sensor;
a mud magnetic sensor;
a mud weight sensor;
a mud particle sensor; and
a mud image analysis system.

4. The drilling mud system of claim 3, wherein the first property is selected from at least one of a group of mud properties consisting of:
a mud resistivity;
a mud viscosity;
a mud temperature;
a mud density;
a mud gamma ray level;
a mud pH value;
a mud chemical composition;
a mud particle chemical composition;
a mud particle size distribution;
a mud particle shape;
a mud magnetic susceptibility; and
a mud weight.

5. The drilling mud system of claim 3, wherein at least one of the sensors is enabled to qualitatively identify in the sample at least one of the group consisting of: hydrocarbons, oil, grease, rubber, and ferrous metals.

6. The drilling mud system of claim 5, wherein at least one of the sensors is enabled to quantitatively identify in the sample at least one of the group consisting of: hydrocarbons, oil, grease, rubber, or ferrous metals.

7. The drilling mud system of claim 1, wherein the mud control system is further enabled for: causing the steering control system to display a visual indication of the first property.

8. The drilling mud system of claim 1, wherein the indication is associated with an identification of a geological formation.

9. The drilling mud system of claim 8, wherein the steering control system is enabled for comparing the identification of the geological formation to a drill plan for the well.

10. The drilling mud system of claim 1, wherein the first additive comprises a loss circulation material (LCM).

11. The drilling mud system of claim 1, wherein the first additive comprises a pre-packaged additive.

12. The drilling mud system of claim 1, wherein a central steering unit is enabled for:

receiving user input specifying the first additive and the first time; and generating the command based in the user input.

13. The drilling mud system of claim 1, wherein the mud additive system further comprises:

a mud additive mixer enabled to quantitatively mix a plurality of additives included in the first additive for adding to the drilling mud according to user input received by the steering control system.

14. The drilling mud system of claim 1, wherein the mud analysis system is enabled for:

generating a plurality of indications respectively associated with a plurality of properties of the sample, including the first property; and interpreting, by the steering control system, a plurality of signals to identify the plurality of properties.

15. A method of drilling mud analysis and control, the method comprising:

diverting a sample of drilling mud obtained from a well during drilling of the well to a mud analysis system enabled to analyze the sample using a plurality of sensors;

generating, by the mud analysis system, a first signal indicative of at least a first property of the sample, wherein the first property is determined by at least one of the sensors;

transmitting the first signal to a steering control system enabled to control at least one drilling parameter used for drilling the well;

interpreting the first signal by the steering control system to identify at least the first property of the sample, wherein the steering control system is enabled to correlate the sample with a depth of the well;

generating a comparison of a first value associated with the first property with a first threshold value for the first property; and based on the comparison, adjusting, by the steering control system, at least one drilling parameter for the well, wherein the at least one of a group of drilling parameters consists of:
a rate of penetration (ROP);
a weight on bit (WOB);
a drilling rotational velocity (RPM);
a mud circulation rate;
a mud pressure; and
a direction of the well.

16. The method of claim 15, wherein adjusting the at least one drilling parameter for the well further comprises adjusting a position of a drill bit in the well.

17. The method of claim 15, wherein the steering control system being enabled to correlate the sample with a depth of the well further comprises at least one selected from a group of techniques consisting of:

comparing the first property with a drill plan for the well;

identifying a time of drilling from a first timestamp indicative of the first signal and a travel time of the drilling mud to a surface; and identifying a pressure of the drilling mud indicative of a velocity of the drilling mud.

18. The method of claim 17, wherein comparing the first property with the drill plan further comprises:

comparing the first property with drill plan information associated with the depth in the drill plan.

19. The method of claim 15, wherein the first property is determined using at least one of a group of sensors consisting of:

a mud resistivity sensor;
a mud rheology sensor;
a mud temperature sensor;
a mud density sensor;
a mud gamma ray sensor;
a mud pH sensor;
a mud chemical sensor;
a mud magnetic sensor;
a mud weight sensor;
a mud particle sensor; and
a mud image analysis system.

20. The method of claim 19, wherein the first property is selected from at least one of a group of mud properties consisting of:

a mud resistivity;
a mud viscosity;
a mud temperature;
a mud density;
a mud gamma ray level;
a mud pH value;
a mud chemical composition;
a mud particle chemical composition;
a mud particle size distribution;
a mud particle shape;
a mud magnetic susceptibility; and
a mud weight.

21. The method of claim 20, wherein at least one of the sensors is enabled to qualitatively identify hydrocarbons, oil, grease, metal, and rubber in the sample.

22. The method of claim 20, wherein at least one of the sensors is enabled to quantitatively identify hydrocarbons, oil, grease, metal, and rubber in the sample.

23. The method of claim 15, further comprising:

generating, by the mud analysis system, a plurality of signals including the first signal, the plurality of signals respectively associated with a plurality of properties of the sample, including the first property; and interpreting, by the steering control system, the plurality of signals to identify the plurality of properties of the sample.

24. The method of claim 15, wherein adjusting the at least one of a group of the drilling parameters based on the first property further comprises:

generating a comparison of a first value associated with the first property with a first threshold value for the first property; and adjusting, by the steering control system, at least one of the at least one of a group of the drilling parameters based on the comparison.

25. The method of claim 15, further comprising:

logging, by the steering control system, the first property versus the depth.

26. The method of claim 25, wherein logging the first property versus the depth further comprises:

generating a log display of at least the first property versus the depth.

27. A method of drilling mud analysis and control, the method comprising:

receiving an indication of drilling mud from sensors of a mud analysis system, wherein the indication is indicative of a first property of a sample, wherein the first property is determined by at least one of the sensors;

generating a comparison of a first value associated with the first property with a first threshold value for the first property;

adjusting at least one of drilling parameters based on the comparison, the at least one of a group of drilling parameters consisting of:

a rate of penetration (ROP);
a weight on bit (WOB);
a drilling rotational velocity (RPM);
a mud circulation rate;
a mud pressure; and
a direction of a well;

receiving, at a mud additive system coupled to a drilling rig, a first additive request from a steering control system of the drilling rig, wherein the first additive request specifies a composition of a first additive to be added to the drilling mud used for drilling by the drilling rig;

based on the first additive request, mixing the composition of the first additive from at least one additive supplied to the mud additive system, wherein the mud additive system includes a mud additive mixer enabled to mix the composition of the first additive; and dosing the first additive into the drilling mud.

28. The method of claim 27, wherein the first additive includes a second additive that is a loss circulation material (LCM).

29. The method of claim 27, wherein the first additive includes a third additive that is a lubricant.

30. The method of claim 27, wherein the first additive is supplied in a packaged form.

31. The method of claim 30, wherein the packaged form is a cable.

32. The method of claim 30, wherein the packaged form is a plurality of unit-sized containers.

33. The method of claim 27, wherein the first additive is selected from at least one of a group of additives consisting of:

a liquid;
a colloid;
a solid-liquid mixture;
a solute dissolved in a solvent;
a powder; and
a particulate.

34. The method of claim 27, wherein receiving the first additive request from the steering control system further comprises:

receiving user input by the steering control system to generate the first additive request, wherein the user input specifies at least one of a group of user inputs consisting of:

the composition of the first additive;
a particle size;
a density;
a concentration of the first additive in the drilling mud; and
a time of delivery of the first additive.

35. The method of claim 27, wherein dosing the first additive into the drilling mud further comprises:

dosing the first additive at a given rate into the drilling mud to achieve a specified concentration of the first additive in the drilling mud.

36. The method of claim 27, further comprising:

receiving, at the mud additive system, a second additive request from the steering control system, wherein the second additive request specifies a composition of a second additive and a drilling operation planned for execution by the steering control system after a minimum delay period.

37. The method of claim 36, wherein the composition of the second additive includes a lubricant, and wherein the drilling operation comprises a slide.

38. The method of claim 36, wherein the minimum delay period depends on at least one of a group of drilling parameters consisting of:

a rate of penetration (ROP);
a weight on bit (WOB);
a differential pressure;
a rotational velocity of a drill bit;
a measured depth;
a mud flow rate;
a drill plan; and
a threshold delay value.

* * * * *